US006834171B2

(12) United States Patent
Nittani et al.

(10) Patent No.: US 6,834,171 B2
(45) Date of Patent: Dec. 21, 2004

(54) DEVELOPER CONTAINER HAVING A GRIP MEMBER, PROCESS CARTRIDGE MOUNTABLE TO AN IMAGE FORMING APPARATUS HAVING SUCH A DEVELOPER CONTAINER, AN IMAGE FORMING APPARATUS DETACHABLY MOUNTING A PROCESS CARTRIDGE HAVING SUCH A DEVELOPER CONTAINER, A BEARING STRUCTURE HAVING A GRIP MEMBER, AND A SIDE COVER HAVING A GRIP MEMBER

(75) Inventors: Susumu Nittani, Shizuoka (JP); Kanji Yokomori, Kanagawa (JP); Koji Hashimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/367,870

(22) Filed: Feb. 19, 2003

(65) Prior Publication Data

US 2003/0156855 A1 Aug. 21, 2003

(30) Foreign Application Priority Data

Feb. 20, 2002 (JP) ..... 2002-042533

(51) Int. Cl.[7] ..... G03G 15/08
(52) U.S. Cl. ..... 399/103; 399/106; 399/262
(58) Field of Search ..... 399/103, 105, 399/106, 119, 258, 262

(56) References Cited

U.S. PATENT DOCUMENTS 5,740,500 A 4/1998 Hashimoto
5,839,028 A 11/1998 Nomura et al. ..... 399/109
5,878,309 A 3/1999 Nomura et al. ..... 399/111
5,923,924 A 7/1999 Hashimoto ..... 399/111
5,937,237 A * 8/1999 Nonaka et al. ..... 399/106
5,940,657 A 8/1999 Yokomori et al. ..... 399/119
5,943,528 A 8/1999 Akutsu et al. ..... 399/110
5,950,049 A 9/1999 Yokomori et al. ..... 399/119
5,953,562 A 9/1999 Kawaguchi et al. ..... 399/117
6,016,408 A 1/2000 Hashimoto et al. ..... 399/27
6,029,031 A 2/2000 Yokomori et al. ..... 399/109
6,044,235 A 3/2000 Hashimoto ..... 399/99
6,055,406 A 4/2000 Kawai et al. ..... 399/360
6,064,843 A 5/2000 Isobe et al. ..... 399/111
6,072,969 A 6/2000 Yokomori et al. ..... 399/119
6,101,352 A 8/2000 Hashimoto et al. ..... 399/119
6,151,459 A 11/2000 Hashimoto et al. ..... 399/27
6,205,305 B1 * 3/2001 Suzuki et al. ..... 399/106
6,215,969 B1 4/2001 Nomura et al. ..... 399/111
6,246,853 B1 6/2001 Suzuki et al. ..... 399/262
6,324,357 B1 11/2001 Gomi et al. ..... 399/50
6,345,164 B1 2/2002 Yokomori et al. ..... 399/119
6,381,430 B1 4/2002 Yokomori et al. ..... 399/119
6,459,869 B2 10/2002 Nittani et al. ..... 399/111
6,463,232 B1 10/2002 Kawai et al. ..... 399/107
6,463,234 B2 10/2002 Arimitsu et al. ..... 399/113
6,480,687 B1 11/2002 Kawai et al. ..... 399/111
6,496,667 B2 12/2002 Shiratori et al. ..... 399/103

(List continued on next page.)

*Primary Examiner*—William J. Royer
(74) *Attorney, Agent, or Firm*—Fitzpatrick, Cella, Harper & Scinto

(57) ABSTRACT

A developer container of a developing device that is provided in an image forming apparatus, includes: a developer container main body provided with a developer containing portion that contains a developer and a developer supply opening; a sealing member that seals the developer supply opening of the developer container main body; and a grip member for pulling out the sealing member in a longitudinal direction of the developer container main body. The developer container main body and the grip member are integrally molded from resin materials having low compatibility to be separable from each other, and the grip member has a longitudinal dimension extending to an outside of a developer container mounting region of the image forming apparatus.

35 Claims, 20 Drawing Sheets

U.S. PATENT DOCUMENTS

| | | | | |
|---|---|---|---|---|
| 6,505,021 | B2 | 1/2003 | Shibuya et al. | 399/115 |
| 2002/0018668 | A1 | 2/2002 | Kanno et al. | 399/106 |
| 2002/0031368 | A1 | 3/2002 | Kanno et al. | 399/103 |
| 2002/0110386 | A1 | 8/2002 | Kanno et al. | 399/111 |
| 2002/0110388 | A1 | 8/2002 | Yokomori et al. | 399/167 |
| 2003/0091768 | A1 | 5/2003 | Sasatani et al. | 428/35.7 |
| 2003/0161657 | A1 * | 8/2003 | Yokoi et al. | 399/119 |

* cited by examiner

DEVELOPER CONTAINER HAVING A GRIP MEMBER, PROCESS CARTRIDGE MOUNTABLE TO AN IMAGE FORMING APPARATUS HAVING SUCH A DEVELOPER CONTAINER, AN IMAGE FORMING APPARATUS DETACHABLY MOUNTING A PROCESS CARTRIDGE HAVING SUCH A DEVELOPER CONTAINER, A BEARING STRUCTURE HAVING A GRIP MEMBER, AND A SIDE COVER HAVING A GRIP MEMBER

BACKGROUND OF THE INVENTION

1. Field of the Invention

The present invention relates to a developer container, a developing container, a developing device, a process cartridge, a side cover, and a bearing structure mounted on an image forming apparatus such as a copier or a printer adopting an electrophotographic process, and an image forming apparatus.

2. Related Background Art

Conventionally, image forming apparatuses using an electrophotographic image forming process adopt a process cartridge system in which an electrophotographic photosensitive member, process means for acting on the electrophotographic photosensitive member, a developing device and the like are integrated in a cartridge, and the cartridge is detachably mountable to the image forming apparatus. According to the process cartridge system, a user can perform operational maintenance of the apparatus without relying on a serviceman, so that the operability can be remarkably enhanced. Thus, the process cartridge system is widely used in image forming apparatuses.

In the above-mentioned developing device and process cartridge, the following is proposed: a developer container (toner container) containing a developer (toner) is connected to a developing container holding a developer bearing member (developing roller), a developer regulating member (developing blade) and the like, and an opening of the toner container for supplying toner to the developing container is sealed with a sealing member (toner seal) for sealing a developer, whereby toner is prevented from flowing to the developing container before the commencement of use. A user pulls a seal grip (pull-tab) provided on the process cartridge at the commencement of use, removes the toner seal fixed to the seal grip, and thereafter, mounts a process cartridge to the image forming apparatus.

In order to make more widespread the use of the above-mentioned cartridge type image forming apparatus, higher efficiency of mounting/detaching operation of the process cartridge, enhancement of the reliability and safety of an operation, a decrease in cost by reduction of the number of components and the number of processes, and the like are desired.

SUMMARY OF THE INVENTION

The present invention has been made in view of the above-mentioned unsolved problem of the conventional art. An object of the present invention is as follows: a grip (seal grip) of a toner seal is designed so as to be pulled out in a longitudinal direction of a process cartridge; the seal grip is placed on an outer side in a longitudinal direction from a guide width set for mounting/detaching the process cartridge with respect to an image forming apparatus; and the process cartridge is adapted such that it cannot be mounted to the image forming apparatus unless the seal grip is removed. Therefore, an image forming operation is prevented from being started under the condition that toner is not supplied to the developing container, which could damage the process cartridge. Furthermore, the invention provides a developer container, a developing container, a developing device, a process cartridge, a side cover, a bearing structure, and an image forming apparatus, which can contribute to the enhancement of efficiency and reliability of a mounting/detaching operation of a process cartridge.

Another object of the present invention is as follows: a toner container, a developing container, a bearing member or a side cover, and a seal grip are integrally molded by two-color molding from materials having low mutual compatibility, such that they are separable from each other. Because of this, the number of components, the number of assembly processes, and the like can be reduced. Furthermore, the dimensional stability of the toner container, the developing container, the bearing member, or a fitting portion between the side cover and the seal grip is ensured, thereby reducing the force required for separating the seal grip. Furthermore, an inexpensive construction is realized which is capable of preventing the seal grip from coming off due to vibration or the like during transportation.

Another object of the present invention is as follows: the seal grip is molded by two-color molding as described above so that the color of the seal grip can be set arbitrarily without increasing the number of components, whereby a user can easily discriminate the seal grip when removing a toner seal in an operation of mounting the process cartridge.

Another object of the present invention is to provide a developer container of a developing device provided in an image forming apparatus, including: a developer container main body provided with a developer containing portion that contains a developer and a developer supply opening; a sealing member that seals the developer supply opening of the developer container main body; and a grip member for pulling out the sealing member in a longitudinal direction of the developer container main body, in which the developer container main body and the grip member are integrally molded from using resin materials having low mutual compatibility so as to be separable from each other, and the grip member has a longitudinal dimension extending to an outside of a developer container mounting region of the image forming apparatus.

Another object of the present invention is to provide a developer container, which cannot be mounted to an image forming apparatus main body unless a seal grip is removed, a developing container, a developing device, a process cartridge, a side cover, a bearing structure and an image forming apparatus.

Another object of the present invention is to provide a developer container, a developing container, a developing device, a process cartridge, a side cover, and a bearing structure in which mounting operability is enhanced, and an image forming apparatus.

Another object of the present invention is to provide a developer container, a developing container, a developing device, a process cartridge, a side cover, and a bearing structure in which reduction in the number of components and reduction in the number of assembling processes are realized, and an image forming apparatus.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIGS. 9A and 9B are plan views showing a seal grip, in which FIG. 9A shows a state before a toner seal is pulled out, and FIG. 9B shows a state after the toner seal is pulled out.

DESCRIPTION OF THE PREFERRED EMBODIMENTS

Hereinafter, the present invention will be described by way of illustrative embodiments with reference to the drawings.

(Entire configuration of a multicolor image forming apparatus)

Figure 1:
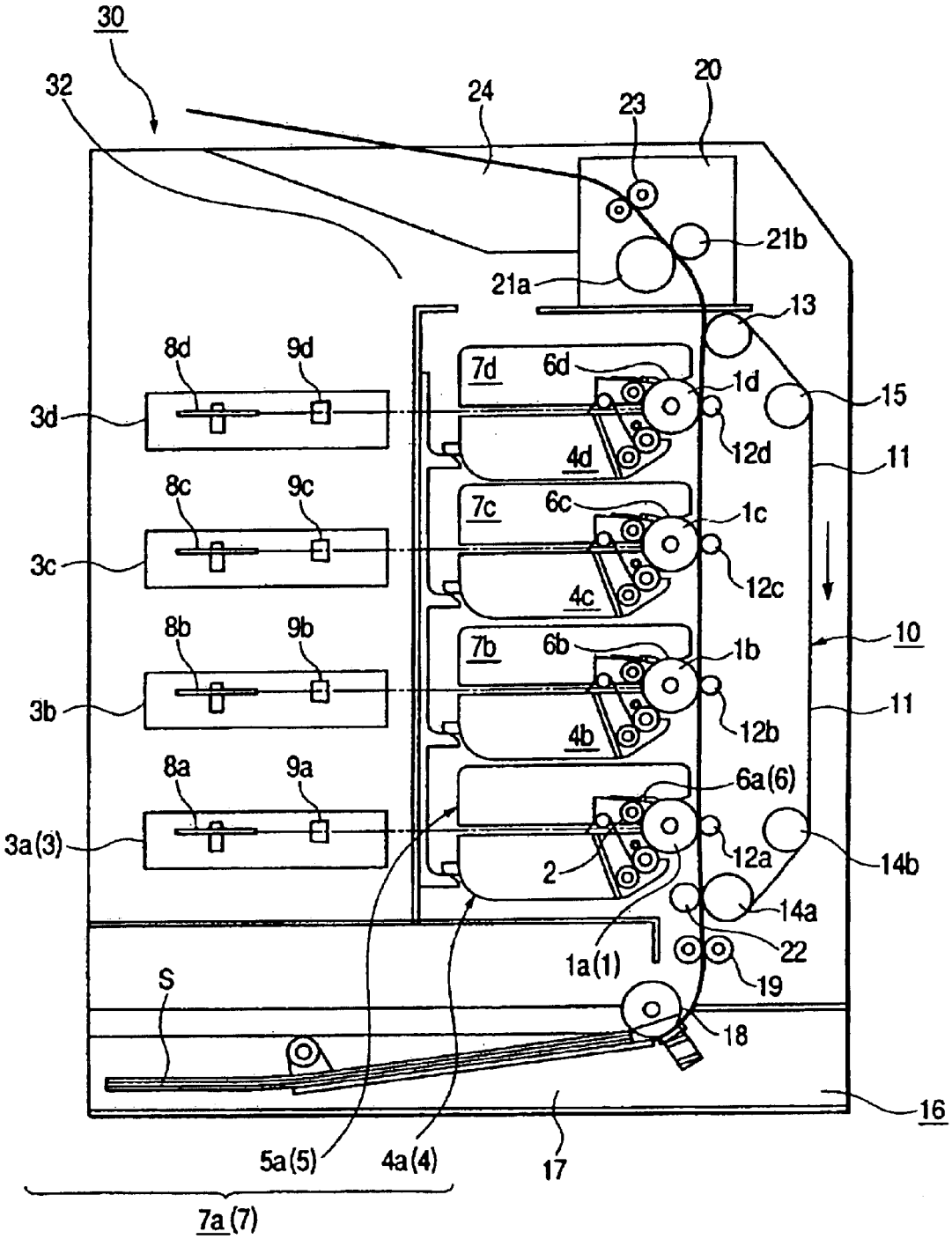
FIG. 1 is a schematic cross-sectional view showing a multicolor image forming apparatus according to a first embodiment of the invention.

FIG. 1 is a vertical cross-sectional view showing the entire configuration of a full-color laser beam printer that is one embodiment of a multicolor image forming apparatus.

The multicolor image forming apparatus shown in FIG. 1 includes four photosensitive drums 1 (1*a*, 1*b*, 1*c*, 1*d*) arranged in parallel in a vertical direction. The photosensitive drums 1 are driven to rotate in a counterclockwise direction in FIG. 1 by a driving means (not shown). On the periphery of each photosensitive drum 1, there are provided, in the rotation direction of the photosensitive drum 1 in the following order, a charging device 2 for uniformly charging the surface of the photosensitive drum 1, a scanner unit 3 (3*a*, 3*b*, 3*c*, and 3*d*) for irradiating the photosensitive drum 1 with a laser beam based on image information to form an electrostatic latent image on the photosensitive drum 1, a developing device 4 (4*a*, 4*b*, 4*c*, and 4*d*) for allowing toner to adhere to the electrostatic latent image to develop the electrostatic latent image as a toner image, an electrostatic transfer device 10 for transferring the toner image on the photosensitive drum 1 to a transfer material S, a cleaning device 6 (6*a*, 6*b*, 6*c*, and 6*d*) for removing transfer residual toner remaining on the surface of the photosensitive drum 1 after transfer, a photosensitive drum unit 5 (5*a*) including the photosensitive drum 1, and the like.

Herein, the drum unit 5 including the photosensitive drum 1, the charging device 2, the cleaning device 6, and the like is integrated with the developing device 4 in a cartridge to form a process cartridge 7 (7*a*, 7*b*, 7*c*, and 7*d*).

Hereinafter, the above-mentioned components will be described in detail. First, the photosensitive drum 1 will be described.

The photosensitive drum 1 is configured, for example, by coating an outer peripheral surface of an aluminum cylinder having a diameter of 30 mm with an organic photoconductive layer (OPC photosensitive member). The photosensitive drum 1 is rotatably supported by a drum bearing 50 (see FIG. 2) at both ends. A driving force is transmitted from a driving motor (not shown) to one end of the photosensitive drum 1, whereby the photosensitive drum 1 is rotated to be driven in a counterclockwise direction.

Figure 3:
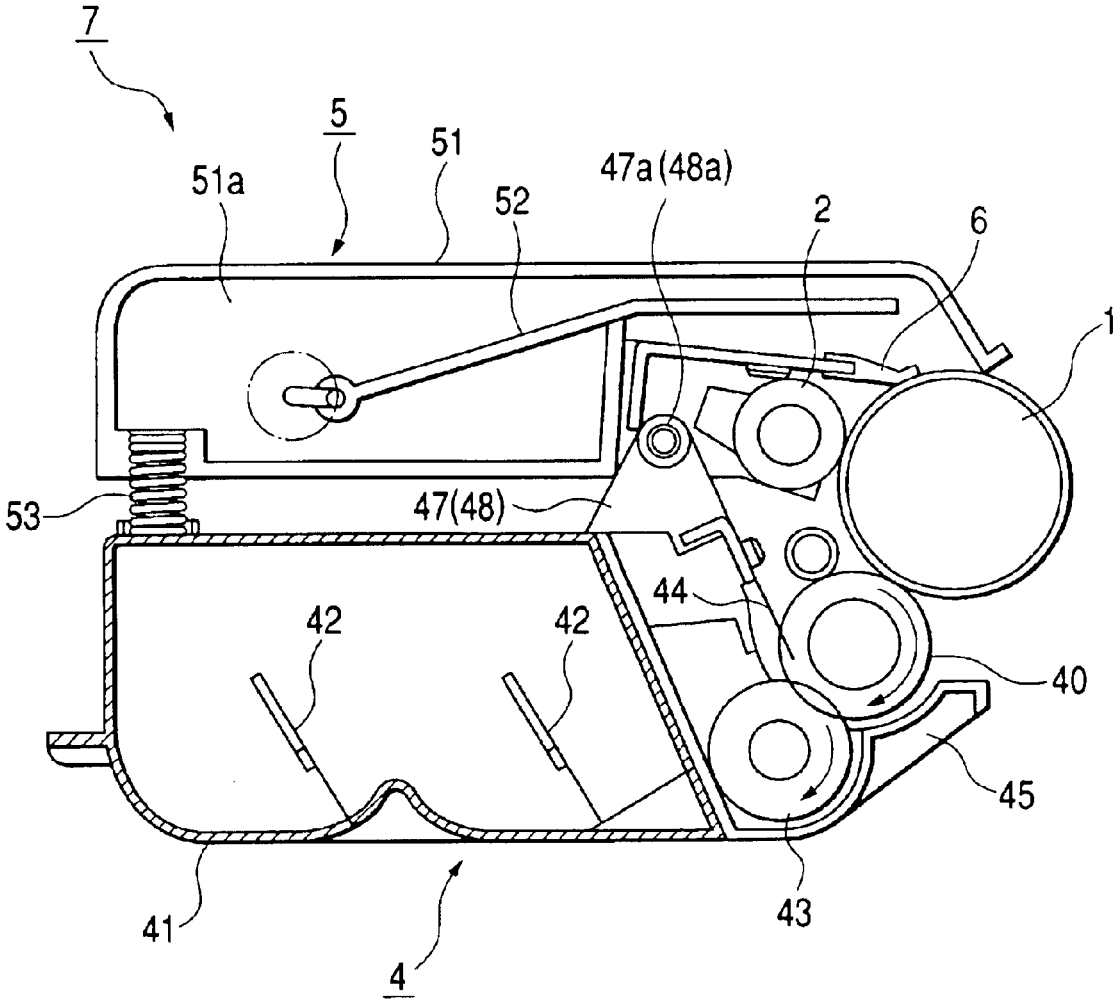
FIG. 3 is a schematic cross-sectional view showing a process cartridge.

As the charging device 2, a contact charge type as shown in FIG. 3 can be used. The charging device 2 is a conductive roller formed in a roller shape. The roller is brought into contact with the surface of the photosensitive drum 1 and a charge bias voltage is applied to the roller, whereby the surface of the photosensitive drum 1 is uniformly charged.

The scanner units 3 (3*a*, 3*b*, 3*c*, and 3*d*) are arranged substantially in horizontal directions from the respective photosensitive drums 1. A laser diode (not shown) irradiates polygon mirrors (8*a*, 8*b*, 8*c*, and 8*d*) to be rotated at a high speed by a scanner motor (not shown) with image light corresponding to an image signal. The surfaces of the charged photosensitive drums 1 are selectively exposed to the image light reflected from the polygon mirrors via imaging lenses (9*a*, 9*b*, 9*c*, and 9*d*), whereby electrostatic latent images are formed on the photosensitive drums 1.

Figure 23:
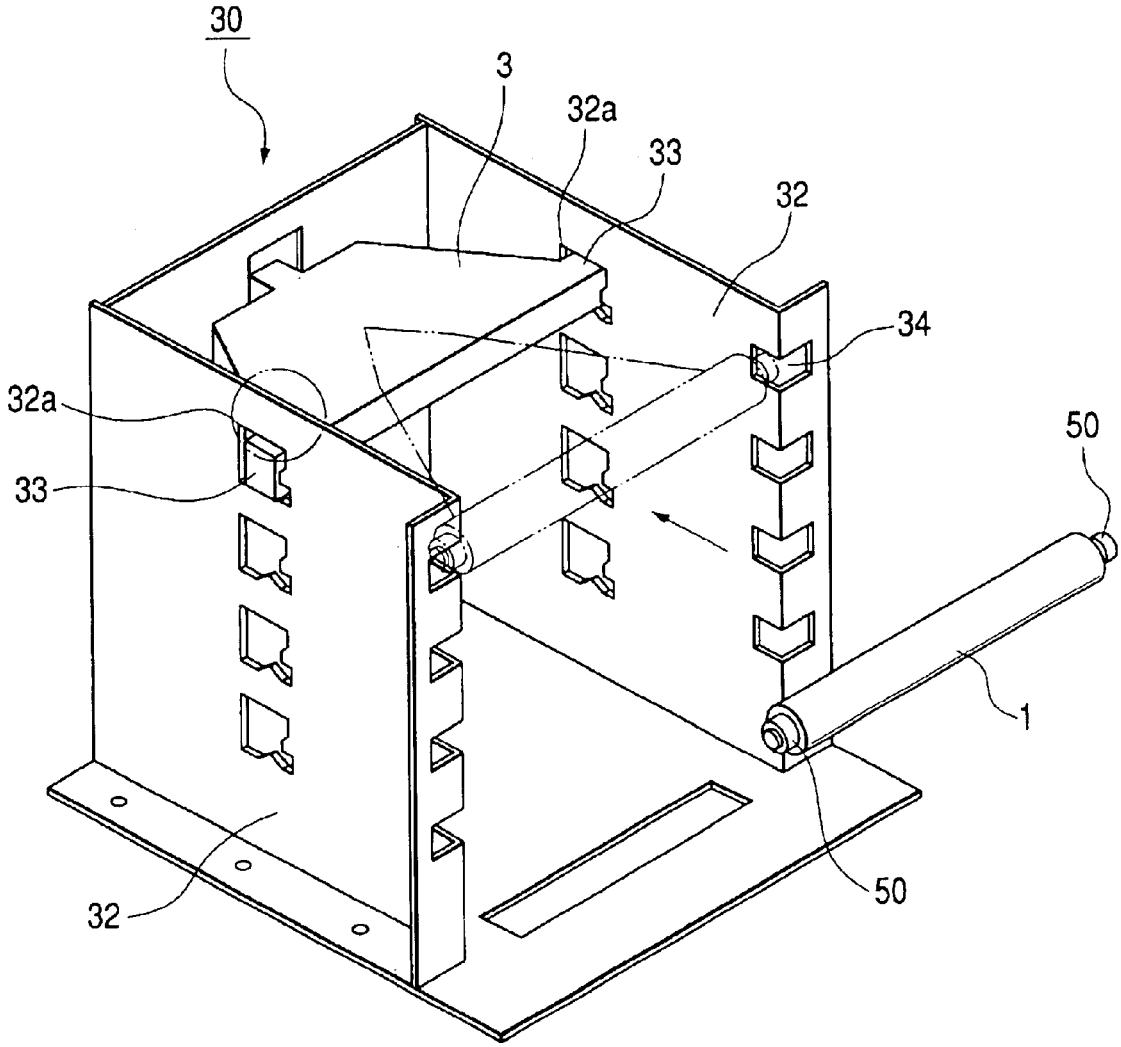
FIG. 23 is a perspective view showing an image forming apparatus main body shown in FIG. 1.
Figure 24:
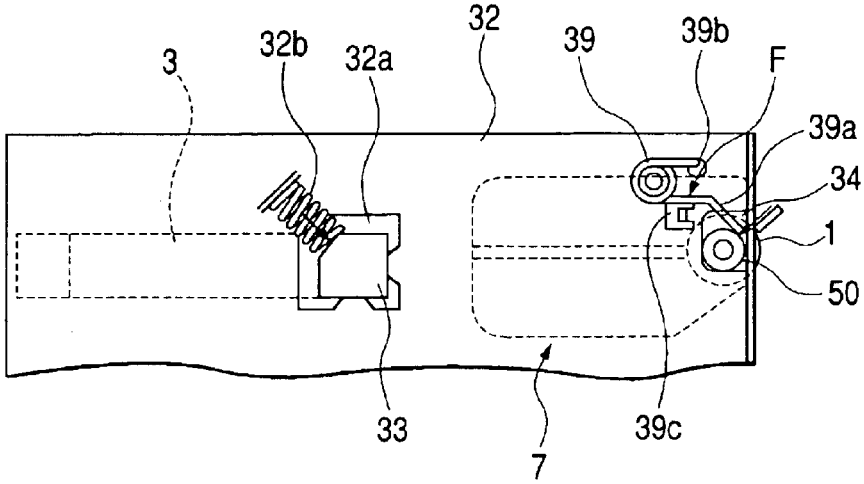
FIG. 24 illustrates an attachment portion of a scanner unit for mounting it to the image forming apparatus.

The scanner unit 3 is formed so as to have a length larger than the pitch between right and left side plates in the longitudinal direction as shown in FIG. 23, whereby projecting portions 33 of the scanner unit 3 project outside through opening holes 32*a* on the side plates 32 constituting an image forming apparatus main body 30. The scanner unit 3 is pressed by a compression spring 32*b* at a force of about 10 N in a downward direction indicated by the arrow at an angle of about 45° to the horizontal direction as shown in FIG. 24. Because of this, the scanner unit 3 can be reliably contacted and pressed against the side plates 32, whereby the scanner unit 3 is positioned.

The electrostatic transfer device 10 shown in FIG. 1 is provided with an electrostatic transfer belt 11 that is circled so as to be opposed to and come into contact with all the photosensitive drums 1*a*, 1*b*, 1*c*, and 1*d*. The electrostatic transfer belt 11 has a volume resistivity of $10^{11}$ to $10^{14}$ Ω·cm, for example, and is composed of a film-shaped member with a thickness of about 150 μm. The electrostatic transfer belt 11 is supported by rollers with four axes in a vertical direction, and is circled so as to electrostatically attract a transfer material S to an outer peripheral surface thereof on the left side in FIG. 1 to bring the transfer material S into contact with the photosensitive drums 1. Because of this, the transfer material S is transported to a transfer position by the electrostatic transfer belt 11, and the toner images on the photosensitive drums 1 are transferred to the transfer material S.

Transfer rollers 12*a*, 12*b*, 12*c*, and 12*d* are arranged in parallel so as to be in contact with the inside of the electrostatic transfer belt 11 and opposed to the four photosensitive drums 1*a*, 1*b*, 1*c*, and 1*d*. A positive charge is applied from these transfer rollers 12*a*, 12*b*, 12*c*, and 12*d* to the transfer material S via the electrostatic transfer belt 11, whereby negative polarity toner images on the photosensitive drums 1 are transferred to a sheet that is in contact with the photosensitive drums 1 by an electric field generated by the charge.

The electrostatic transfer belt 11 has a perimeter of about 700 mm, and is stretched around four rollers: a driving roller 13, also called a belt driving roller, driven rollers 14*a*, 14*b*, and a tension roller 15 to be rotated in a direction indicated by the arrow in FIG. 1. Because of this, a toner image is transferred while the above-mentioned electrostatic transfer belt 11 is circled, and the transfer material S is transported from the driven roller side to the driving roller side.

A feed portion 16 feeds the transfer material S to an image forming portion, and receives plural transfer materials S in a feed cassette 17. During image formation, a feed roller 18 (semicircular roller) and a registration roller pair 19 are rotated to be driven in accordance with an image forming operation, whereby the transfer materials S in the feed cassette 17 are separated and fed one by one. The leading edge of the transfer material S hits against the registration roller pair 19 to stop and form a loop. Thereafter, the rotation of the electrostatic transfer belt 11 and an image writing position are synchronized, and the transfer material S is fed to the electrostatic transfer belt 11 by the registration roller pair 19.

A fixing portion 20 fixes toner images of plural colors transferred to the transfer material S. The fixing portion 20 is composed of a heating roller 21*a* that is rotated, and a pressure roller 21*b* that is pressed against the heating roller 21*a* to give heat and pressure to the transfer material S.

More specifically, the transfer material S with the toner images transferred from the photosensitive drums 1 thereto is transported by a pair of fixing rollers 21*a*, 21*b* and is given heat and a pressure by the pair of fixing rollers 21*a*, 21*b* while passing through the fixing portion 20. As a result, the toner images of plural colors are fixed on the surface of the transfer material S.

The operation of image formation is performed as follows. The process cartridges 7*a*, 7*b*, 7*c*, and 7*d* are driven successively in accordance with a printing timing, and the photosensitive drums 1*a*, 1*b*, 1*c*, and 1*d* are rotated to be driven in a counterclockwise direction in accordance with the driving. Then, the scanner units 3*a*, 3*b*, 3*c*, and 3*d* corresponding the respective process cartridges 7 are driven successively. Because of ifs driving, the charging rollers 2 uniformly charge the peripheral surfaces of the photosensitive drums 1. The scanner units 3 expose the peripheral surfaces of the photosensitive drums 1 to light in accordance with an image signal, thereby forming electrostatic latent images on the peripheral surfaces of the photosensitive drums 1. Developing rollers 40 of the developing devices 4 transfer toner to low potential portions of the electrostatic latent images to form (develop) toner images on the peripheral surfaces of the photosensitive drums 1.

The rotation of the registration roller pair 19 is started to feed the transfer material S to the electrostatic transfer belt 11 in such a manner as follows: the printing start position of the transfer material S is matched with an opposed point with respect to the electrostatic transfer belt 11 at a timing when the leading edge of the toner image on the peripheral surface of the most upstream photosensitive drum 1 is rotated to be transferred to the opposed point.

The transfer material S is pressed against the outer periphery of the electrostatic transfer belt 11 so as to be sandwiched between an electrostatic attracting roller 22 and the electrostatic transfer belt 11. Furthermore, a voltage is applied between the electrostatic transfer belt 11 and the electrostatic attracting roller 22, whereby a charge is generated in the transfer material S that is a dielectric and a dielectric layer of the electrostatic transfer belt 11 so as to electrostatically attract the transfer material S to the outer periphery of the electrostatic transfer belt 11. Because of this, the transfer material S is stably attracted to the electrostatic transfer belt 11 to be transferred to the most downstream transfer portion.

The toner images on the photosensitive drums 1*a*, 1*b*, 1*c*, and 1*d* are successively transferred to the transfer material S being transported due to the electric field formed between the photosensitive drums 1*a*, 1*b*, 1*c*, and 1*d* and the transfer rollers 12*a*, 12*b*, 12*c*, and 12*d*.

The transfer material S with the toner images of four colors transferred thereto is subjected to self stripping from the electrostatic transfer belt 11 by the curvature of a belt driving roller 13 and is placed in the fixing portion 20. The above-mentioned toner images are thermally fixed on the transfer material S in the fixing portion 20. Thereafter, the transfer material S is discharged outside from a discharge portion 24 by a discharge roller pair 23 under the condition that an image surface faces downward.

Figure 2:
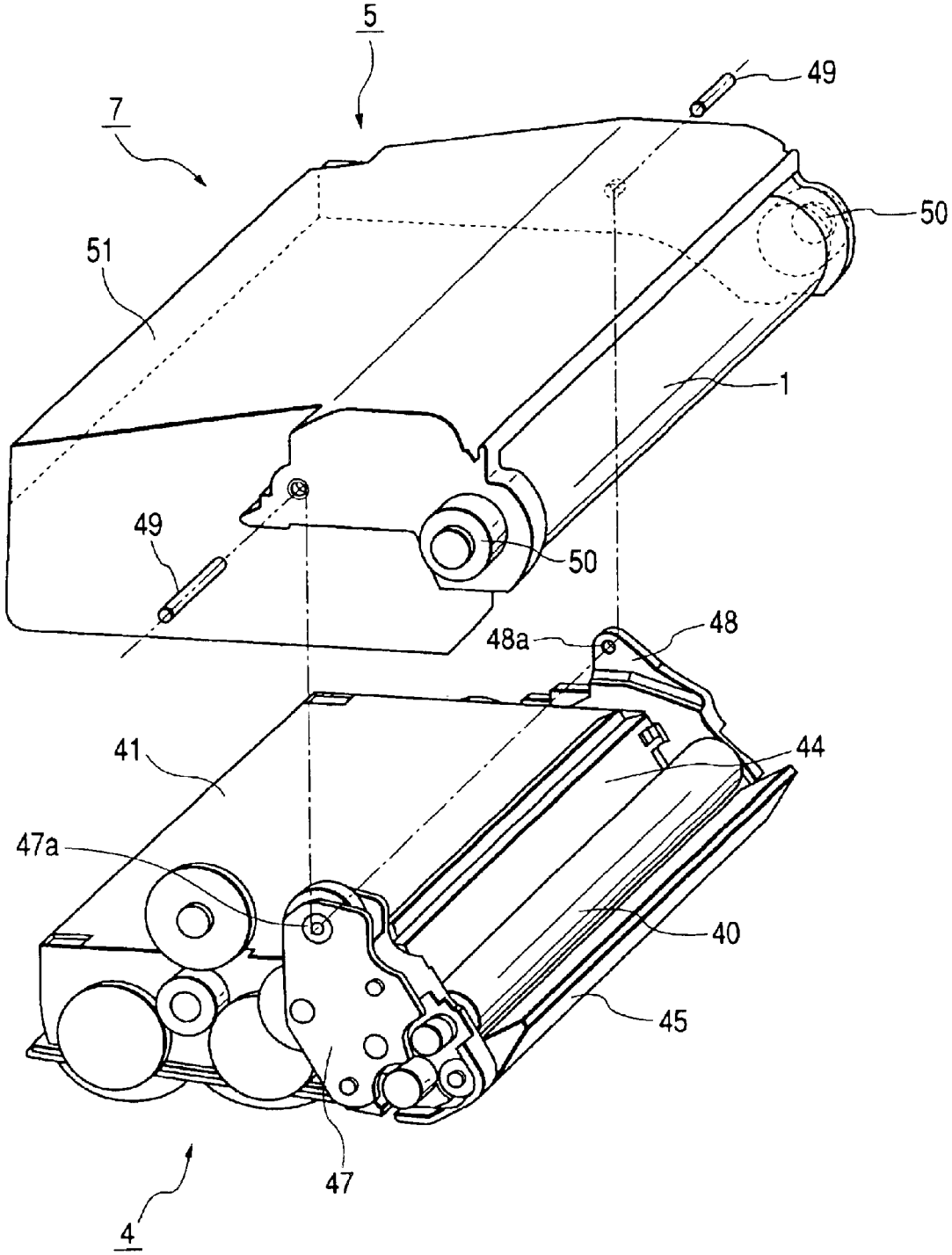
FIG. 2 is an exploded perspective view showing a process cartridge of FIG. 1 in the disassembled state.

FIG. 2 shows the photosensitive drum unit 5 and the developing device 4 of the process cartridge 7 in an exploded state. The respective process cartridges 7*a*, 7*b*, 7*c*, and 7*d* of yellow, magenta, cyan, and black have the same configuration.

As shown in FIGS. 2 and 3, the process cartridge 7 is separated into the photosensitive drum unit 5 including the photosensitive drum 1, the charging device 2 and the cleaning device 6, and the developing device 4 including the developing roller 40 for developing an electrostatic latent image on the photosensitive drum 1.

In the photosensitive drum unit 5, the photosensitive drum 1 is rotatably attached to a cleaning frame 51 via the drum bearing 50. On the periphery of the photosensitive drum 1, the charging device (primary charging means) 2 for uniformly charging the surface of the photosensitive drum 1 and the cleaning device (cleaning blade) 6 for removing a developer (toner) remaining on the photosensitive drum 1 are placed. Furthermore, the residual toner removed from the surface of the photosensitive drum 1 by the cleaning device 6 is successively transported to a waste toner chamber 51*a* provided at the back of the cleaning frame 51 by a toner transportation mechanism 52. Then, by transmitting a driving force of a driving motor (not shown) to one end at the back in FIG. 3, the photosensitive drum 1 is rotated to be driven in a counterclockwise direction in FIG. 3 in accordance with an image forming operation.

The developing device 4 is composed of the developing roller 40 as a developer bearing member that is in contact with the photosensitive drum 1 while rotating in a direction indicated by the arrow, a toner container 41 that is a developer container main body for forming a developer containing portion containing toner (developer), and a developing container 45. The developing roller 40 is rotatably supported by the developing container 45 via bearing members 47 and 48. On the periphery of the developing roller 40, there are arranged a toner supply roller 43 that is in contact with the developing roller 40 while rotating in a direction indicated by the arrow and a developing blade 44 as a developer regulating member. Furthermore, a toner feeding mechanism 42 for feeding toner contained in the toner container 41 and transporting the toner to the toner supply roller 43 is provided in the toner container 41.

The developing device 4 has a suspension structure in which the entire developing device 4 is supported swingably with respect to the photosensitive drum unit 5 by pins 49 around connection portions 47*a* and 48*a* provided respectively at the bearing members 47 and 48 attached to both ends of the developing device 4. In the state of a single body of the process cartridge 7 (which is not attached to a printer main body), the developing device 4 is always biased by a compression spring 53 so that the developing roller 40 comes into contact with the photosensitive drum 1 by a rotation moment with respect to the pins 49.

Figure 21:
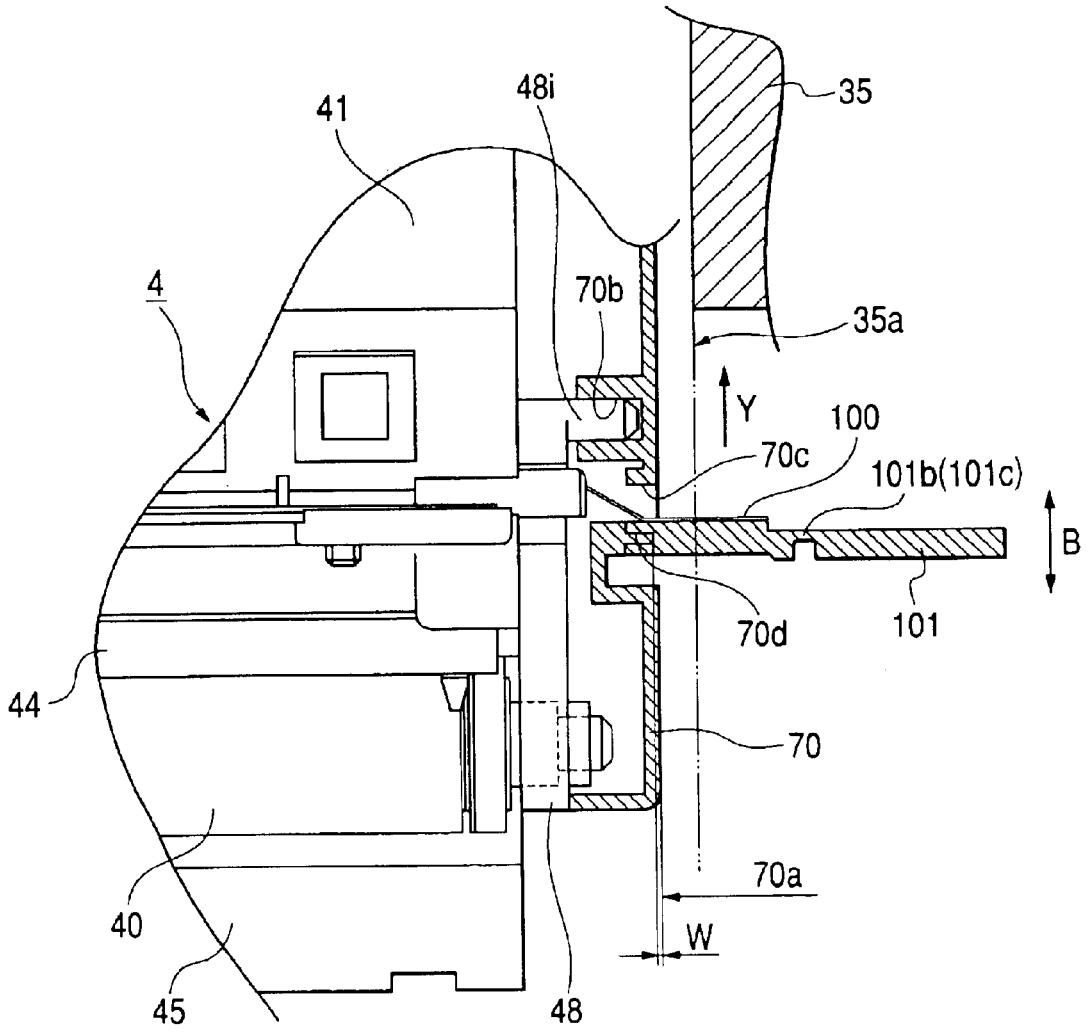
FIG. 21 is a cross-sectional view showing a connection portion between a side cover and a seal grip according to the fourth embodiment of the invention.
Figure 25:
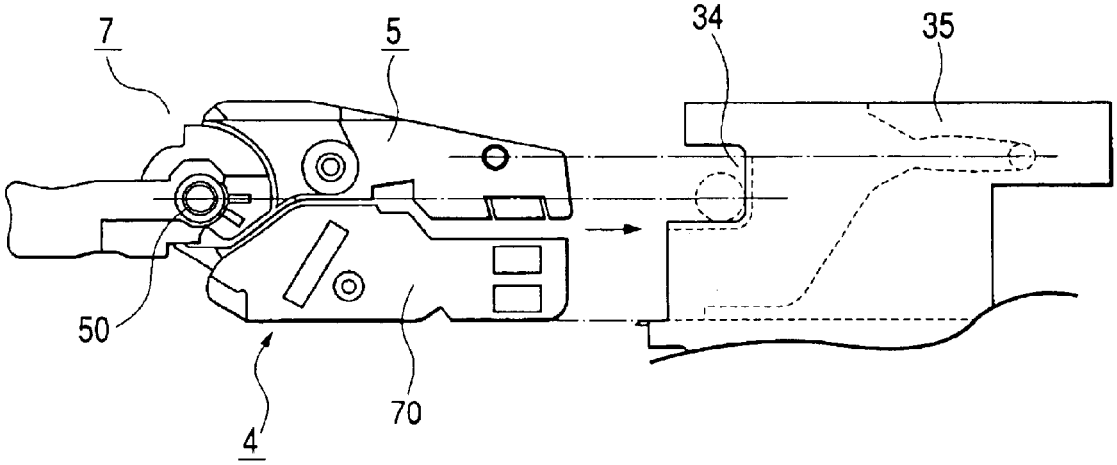
FIG. 25 illustrates a method for mounting a process cartridge to the image forming apparatus.

Furthermore, as shown in FIGS. 21 and 25, side covers 70 are provided outside of the bearing members 47 and 48 of the developing device 4. The side face of the photosensitive drum unit 5 and the side cover 70 of the developing device 4 form the side face of the process cartridge 7.

During development, when the contained toner is transported to the toner supply roller 43 by the toner transporting mechanism 42, the toner supply roller 43 that is rotated in the direction indicated by the arrow supplies the toner to the developing roller 40 by rubbing with respect to the developing roller 40 that is rotated in the same direction, thereby allowing the developing roller 40 to bear the toner. The toner borne on the developing roller 40 reaches the developing blade 44 along with the rotation of the developing roller 40. The developing blade 44 regulates the toner to form a predetermined thin toner layer. The regulated toner reaches a charging roller as a developer charging means along with the rotation of the developing roller 40, whereby a desired charge amount is given to the toner. Furthermore, the thin toner layer on the developing roller 40 is transported to a developing portion in which the photosensitive drum 1 is in contact with the developing roller 40. In the developing portion, the toner adheres to an electrostatic latent image formed on the surface of the photosensitive drum 1 due to a D.C. developing bias applied to the developing roller 40 from a power source (not shown), thereby developing a latent image. The toner remaining on the surface of the developing roller 40, which does not contribute to the development, is returned to the developing container 45 along with the rotation of the developing roller 40, and peeled to be collected from the developing roller 40 in the rubbing portion in which the toner supply roller 43 rubs against the developing roller 40. The collected toner is mixed and agitated with the remaining toner by the toner transporting mechanism 42, which also serves as a toner agitating mechanism for agitating the toner.

According to the contact development system for performing development under the condition that the photosensitive drum 1 is in contact with the developing roller 40 as in the present invention, it is preferable that the photosensitive drum 1 is made of a rigid main body, and the developing roller 40 has an elastic material. As the elastic material, a solid rubber single layer, a solid rubber layer coated with a resin considering the electrostatic charging property of the toner, or the like is used.

The process cartridge 7 is mounted to the image forming apparatus main body 30 as follows. Herein, the longitudinal direction refers to an axis direction of the photosensitive drum 1, and a cross-sectional direction refers to a direction orthogonal to the axis of the photosensitive drum 1.

As shown in FIGS. 23 to 25, the process cartridge 7 is mounted to the image forming apparatus main body 30 by guiding the process cartridge 7 to the inside of the apparatus main body 30 along a process cartridge guide 35 in a direction indicated by the arrow shown in FIGS. 23 and 25, and inserting the drum bearing 50 supporting the photosensitive drum 1 into a guide groove 34. Then, the drum bearing 50 is pressed against a hitting surface of the guide groove 34 as represented by a broken line in FIG. 25, whereby the position of the process cartridge 7 is determined. On the other hand, in the longitudinal direction, rough guiding is performed with the process cartridge guide 35 and the side face of the process cartridge 7, and thereafter, the positioning portion on the side face of the photosensitive drum unit 5 is pressed against a predetermined position of the image forming apparatus main body 30 by a pressurizing unit (not shown) from the side face of the image forming apparatus main body 30, whereby positioning in the longitudinal direction is completed.

The process cartridge 7 is held in the image forming apparatus main body 30 in a cross-sectional direction by a method as shown in FIG. 24. A shaft 39 is crimped against right and left side plates 32, and torsion coil springs 39*a* are supported by the shaft 39. The ends of the torsion coil springs 39*a* are embedded in holes 39*b* of the right and left side plates 32 so as to be fixed therein. In the absence of the process cartridge 7, torsion coil springs 39*a* are regulated in a rotation direction by raisings 39*c* bent from the right and left side plates 32. When the process cartridge 7 is inserted, the torsion coil springs 39*a* are rotated in a counterclockwise direction against their force. When the torsion coil springs 39*a* pass over the drum bearing 50, the torsion coil springs 39*a* are positioned as shown in FIG. 24, and provide a force F of about 10 N in a direction indicated by the arrow, thereby positioning the process cartridge 7.

(Embodiment 1)

FIGS. 4 through 10, 11A and 11B show a configuration of a connection portion between the toner container 41 and the developing container 45 according to a first embodiment.

Figure 4:
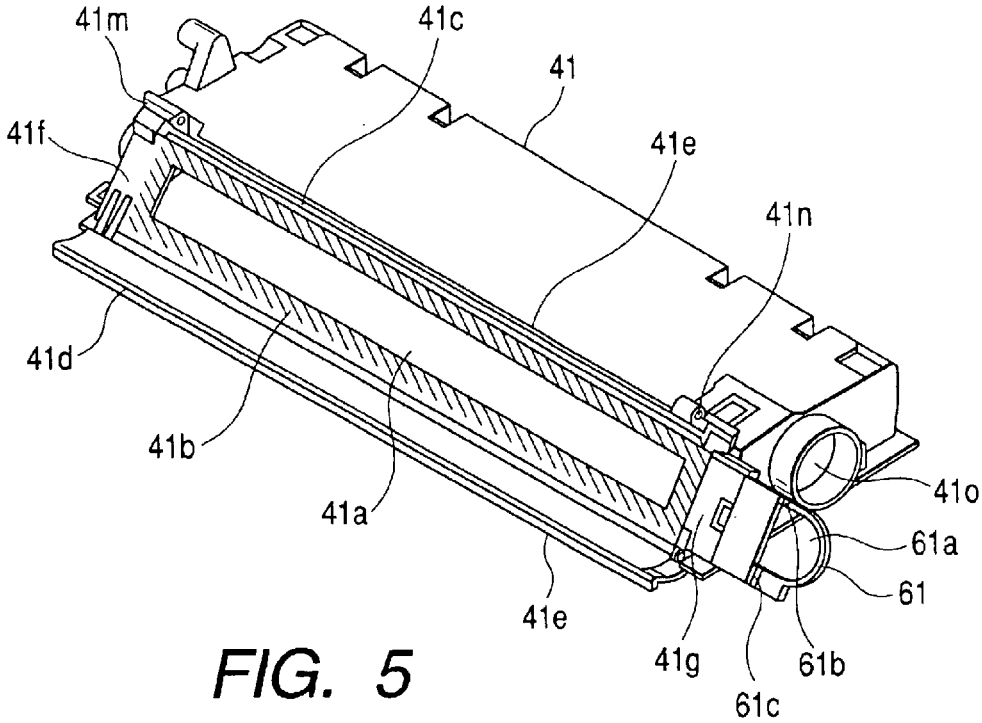
FIG. 4 is a perspective view showing a toner container.

As shown in FIG. 4, the toner container 41 (developer container) is provided with an opening 41*a* that is a developer supply opening for sending toner from the toner container 41 to the developing container 45. On the periphery of the opening 41*a*, a welding surface 41*b* for a toner seal 60 (sealing member) described later is provided. Flange portions 41*c* and 41*d* are provided at upper and lower edges of the welding surface 41*b* in a lateral direction, and the flange portions 41*c* and 41*d* are provided with thread grooves 41*e* in parallel in a longitudinal direction.

Figure 5:
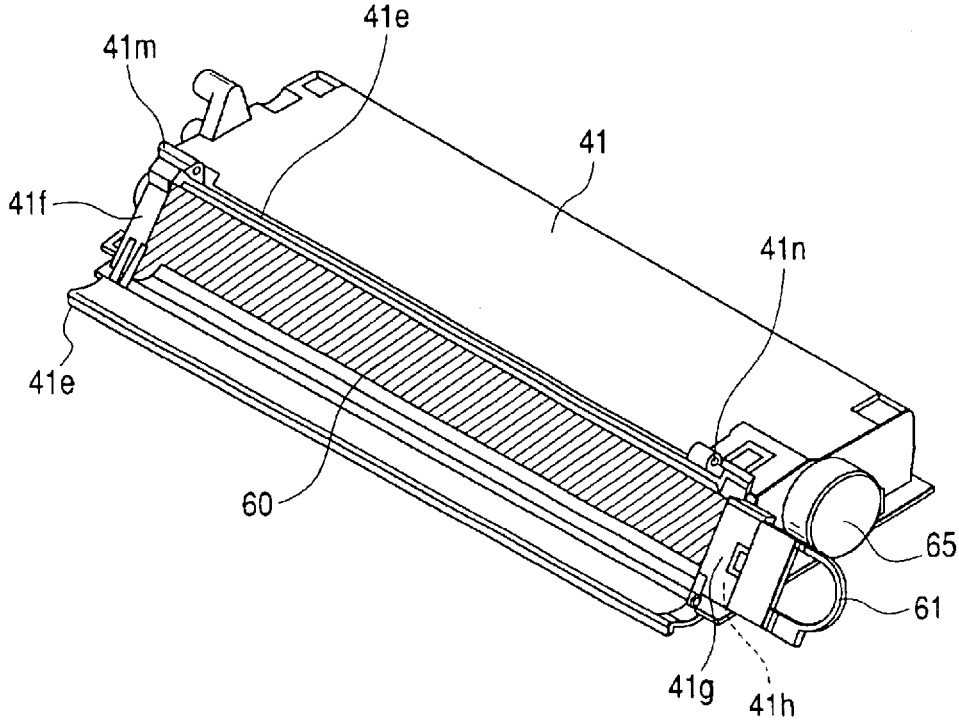
FIG. 5 is a perspective view showing a toner container with a toner seal attached thereto.
Figure 6A:
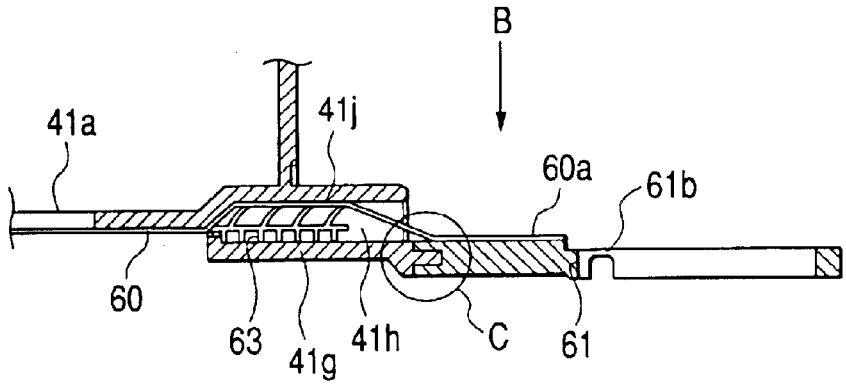
FIGS. 6A, 6B, and 6C illustrate a seal grip and an end portion of a toner seal.
Figure 6B:
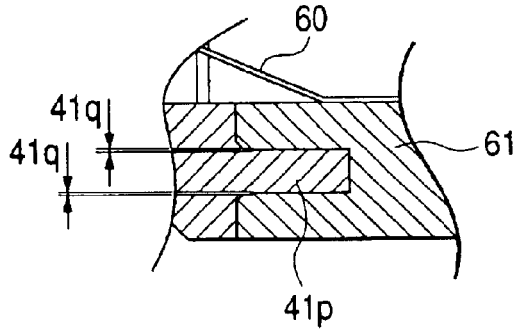
Figure 6C:
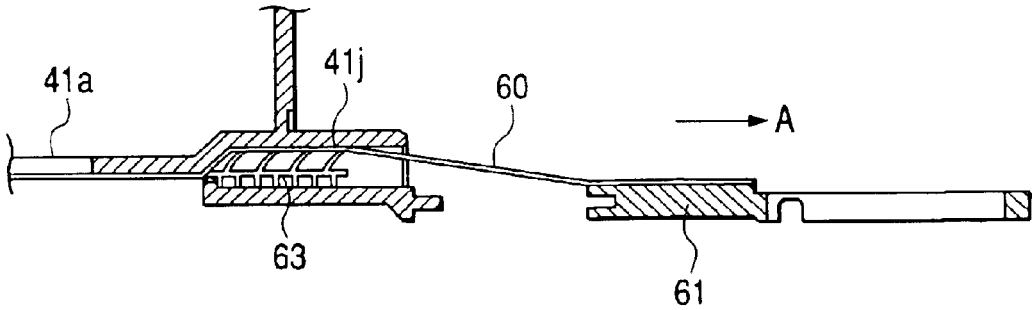

The toner seal 60 shown in FIG. 5 is attached to the welding surface 41*b* of the toner container 41 so as to cover the opening 41*a* by welding, bonding, or the like. The toner seal 60 is folded at an end portion 41*f* of the opening 41*a* in the longitudinal direction, and is drawn outside through a hollow portion 41*h* of an end portion 41*g* on the opposite side in the longitudinal direction, as shown in FIGS. 6A, 6B, and 6C.

A seal grip 61 that is a grip member is integrally molded to the end portion 41*g* having the hollow portion 41*h* of the toner container 41. The seal grip 61 is integrally molded to the end portion 41*g* of the toner container 41 by a resin molding method that is a so-called two-color molding using two resin materials, which are easily separable from each other due to their low compatibility and have different colors.

An end portion 60*a* of the toner seal 60 is attached to the seal grip 61. By pulling the seal grip 61 in the longitudinal direction of the toner container 41, the toner seal 60 can be removed from the toner container 41 (which will be described later in detail).

Furthermore, a cap member 63 made of a material with a satisfactory sliding property and flexibility (e.g., elastomer rubber) is inserted in the hollow portion 41*h* of the toner container 41. The toner seal 60 is sandwiched between a wall surface 41*j* of the hollow portion 41*h* of the toner container 41 and the cap member 63.

Figure 7:
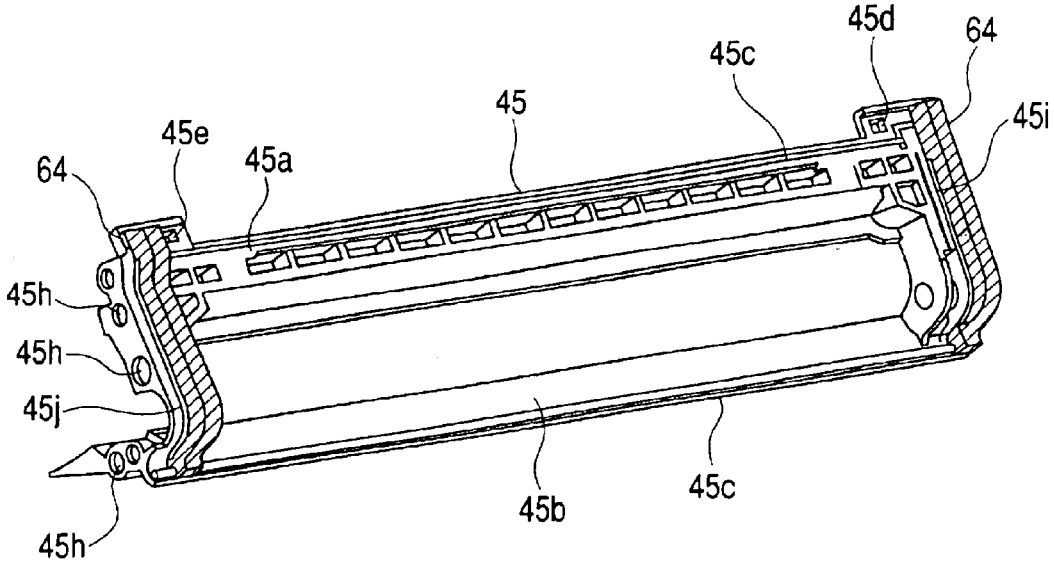
FIG. 7 illustrates an elastic sealing member of a developing container.
Figure 8:
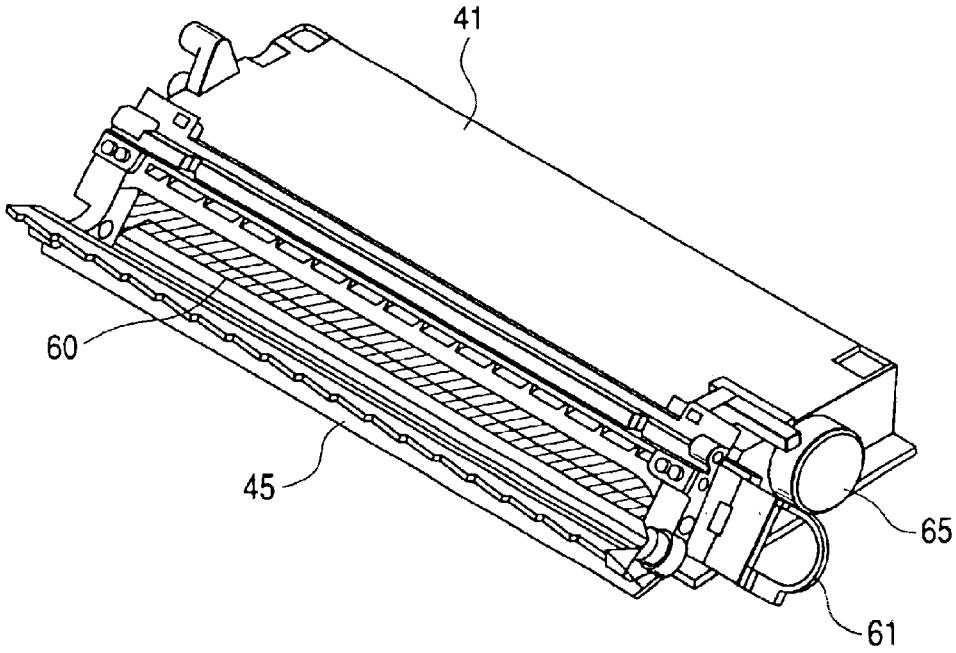
FIG. 8 shows a state where a developing container and a toner container are integrated as a unit.

FIG. 7 shows the developing container 45 seen from the direction of the surface to be connected to the toner container 41. As shown in FIG. 7, a protruded thread 45*c* engaged in the thread groove 41*e* of the toner container 41 is provided in the longitudinal direction on surfaces 45*a* and 45*b* of the developing container 45 opposed to the toner container 41. A triangular protruded thread for ultrasonic welding is provided on the top surface of the protruded thread 45*c*.

Furthermore, an elastic sealing member 64 such as urethane foam and expanded rubber is attached to end portions 45*i* and 45*j* of the developing container 45 in the longitudinal direction of a flat surface opposed to the toner container 41. Alternatively, the end portions 45*i* and 45*j* are coated with the elastic sealing member 64. The position of the elastic sealing member 64 is matched with the end portions 41*f* and 41*g* of the toner container 41 in the longitudinal direction. The elastic sealing member 64 extends over the entire width in the lateral direction, and is overlapped with the protruded thread 45*c*. In the present embodiment, the elastic sealing member 64 is attached to the developing container 45. However, it may be provided on the toner container 41.

Furthermore, in order to easily align the toner container 41 with the developing container 45 when connecting them, rectangular bosses 41*m* and 41*n* to be fitted into rectangular holes 45*d* and 45*e* placed on the developing container 45 are provided on the flange portion 41*c* of the toner container 41. Herein, the rectangular hole 45*d* is tightly fitted onto the rectangular boss 41*m*, and the rectangular hole 45*e* is fitted onto the rectangular boss 41*n* tightly in the lateral direction and roughly in the longitudinal direction.

The toner container 41 and the developing container 45 are connected to each other as follows.

First, the opening 41*a* of the toner container 41 is sealed with the toner seal 60. Thereafter, toner is placed through a toner filling port 41*a*, and the toner filling port 41*a* is sealed with a toner cap 65 (see FIGS. 4 and 5). Thereafter, the rectangular bosses 41*m* and 41*n* for positioning the toner container 41 are fitted into the rectangular holes 45*d* and 45*e* for positioning the developing container 45 (see FIG. 7). Furthermore, the protruded thread 45*c* of the developing container 45 is fitted into in the thread groove 41*e* of the toner container 41.

The toner container 41 and the developing container 45 are pressed to each other, and an ultrasonic vibration is provided between the protruded thread 45*c* and the thread groove 41*e* in this state. A rectangular protruded thread provided on the protruded thread 45*c* is melted by friction heat to be welded to the bottom of the thread groove 41*e*. Thus, a unit of the toner container 41 and the developing container 45 is completed (see FIG. 8).

In order to send the toner contained in the toner container 41 to the developing container 45 so that the process cartridge 7 is made usable, the seal grip 61 projecting outside of the process cartridge 7 is pulled, whereby the toner seal 60 is drawn out. Because of this, the opening 41*a* of the toner container 41 is opened, and the toner can be sent from the toner container 41 to the developing container 45, i.e., the usable state of the process cartridge 7 is obtained. At this time, the cap member 63 shown in FIGS. 6A and 6C adheres to the wall surface 41*j* of the hollow portion 41*h* of the toner container 41 after the toner seal 60 is pulled out, thereby preventing the toner from leaking outside.

As the toner seal 60, there is a combination of a cover film for sealing the opening of the toner container 41 and a tear tape for tearing the cover film, in addition to the above-mentioned easy peel type using one folded sheet. The present invention is applicable to any of these toner seals.

The toner container 41 and the developing container 45 may be connected to each other in the following configuration (see FIGS. 11A and 11B).

As described above, the opening 41*a* for sending toner from the toner container 41 to the developing container 45 is provided at the connection portion between the toner container 41 and the developing container 45. The welding surface 41*b* of the toner seal 60 is provided on the periphery of the opening 41*a*. The flange portions 41*c* and 41*d* are provided at the upper and lower edges of the welding surface 41*b* in the lateral direction, and the thread groove 41*e* is provided at the flange portions 41*c* and 41*d* in the longitudinal direction.

The protruded thread 45*c* to be fitted into the thread groove 41*e* of the toner container 41 is provided on the surfaces 45*a* and 45*b* of the developing container 45 opposed to the toner container 41 in the longitudinal direction. The rectangular protruded thread for ultrasonic welding is provided at the top surface of the protruded thread 45*c*.

An elastic sealing member 64 is attached to the end portions 45*i* and 45*j* of the developing container 45, and the position thereof in the longitudinal direction is matched with the end portions 41*f*, and 41*g* of the toner container 41. Furthermore, the elastic sealing member 64 extends over the entire width in the lateral direction and is overlapped with the protruded thread 45*c*.

The toner seal 60 is attached to the welding surface 41*b* of the toner container 41 so as to cover the opening 41*a* by welding, bonding, or the like. One end of the toner seal 60 is folded at one end portion 41*f*, and the end portion 60*a* of the toner seal 60 is fixed to the surface side of the seal grip 61 at the other end portion 41*g*.

First, the opening 41*a* of the toner container 41 is sealed with the toner seal 60. Thereafter, toner is placed through the toner filling port 41*o*, and the toner filling port 41*o* is sealed with the toner cap 65.

Thereafter, the rectangular bosses 41*m* and 41*n* for positioning the toner container 41 are engaged in the rectangular holes 45*d* and 45*e* for positioning the developing container 45. Furthermore, the protruded thread 45*c* of the developing container 45 is fitted into the thread groove 41*e* of the toner container 41. Then, the toner container 41 and the developing container 45 are pressed to each other, whereby the elastic sealing member 64 comes into contact with the end portions 41*f* and 41*g* of the toner container 41 in the longitudinal direction to be compressed.

The toner container 41 and the developing container 45 are pressed, and an ultrasonic vibration is provided between the protruded thread 45*c* and the thread groove 41*e* in this state. The rectangular protruded thread provided on the protruded thread 45*c* is melted by friction heat to be welded to the bottom of the thread groove 41*e*. Thus, the elastic sealing member 64 adheres between the toner container 41 and the developing container 45 as shown in FIG. 11B. When the gap between the toner container 41 and the developing container 45 is sealed, the toner seal 60 is held adhering to a tape 64*a* attached to the surface of the elastic sealing member 64. Thus, a unit of the toner container 41 and the developing container 45 is completed in the same way as described above.

In order to send the toner contained in the toner container 41 to the developing container 45 so that the process cartridge 7 is made usable, the seal grip 61 projecting outside of the process cartridge 7 is pulled, whereby the toner seal 60 is drawn out. Because of this, the opening 41*a* of the toner container 41 is opened, and the toner can be sent from the toner container 41 to the developing container 45, i.e., the usable state of the process cartridge 7 is obtained.

Figure 11A:
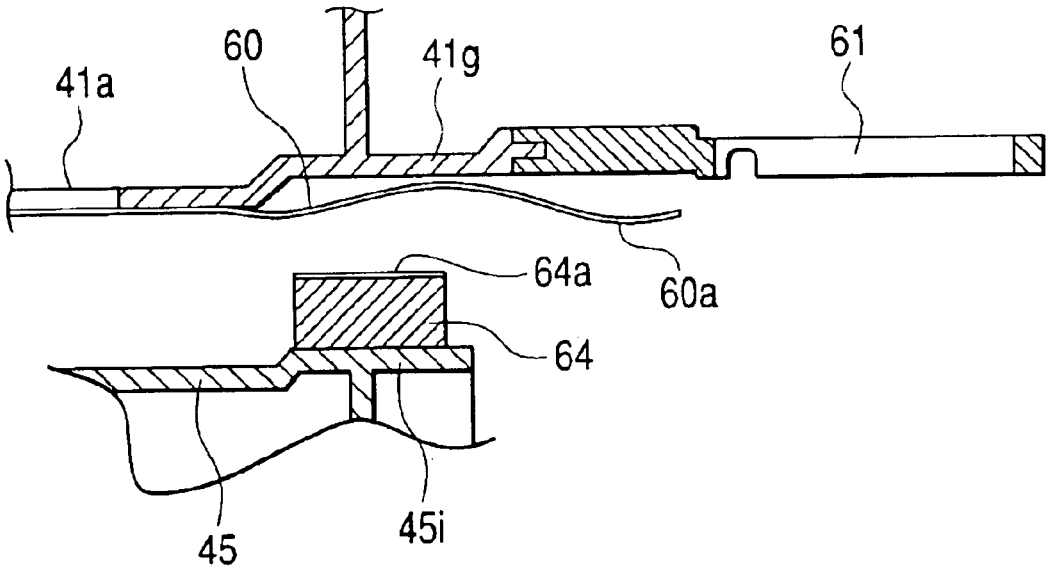
FIGS. 11A and 11B illustrate another embodiment of a structure for connecting a toner seal to a toner container.
Figure 11B:
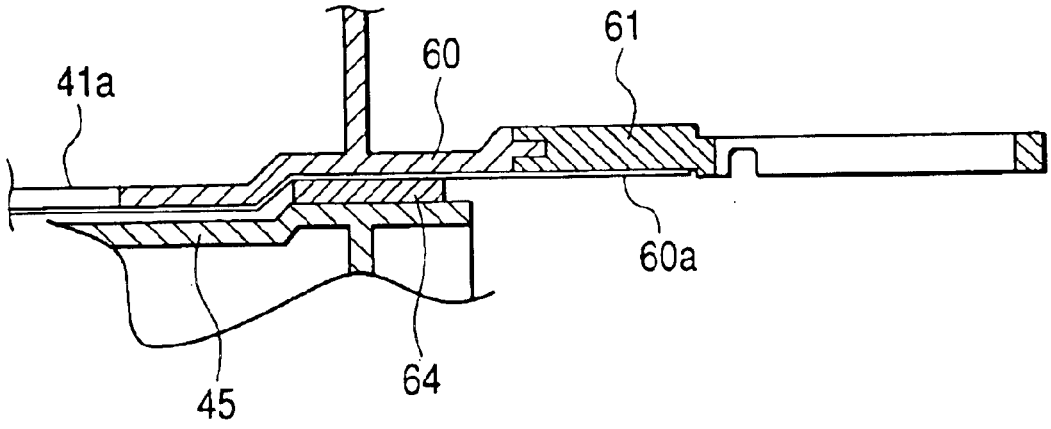

Herein, in the configuration shown in FIGS. 11A and 11B, the elastic sealing member 64 is compressed by the toner container 41 and the developing container 45 while keeping its rectangular cross-section. Therefore, the elastic sealing member 64 has a satisfactory sealing property. Furthermore, the toner seal 60 can be smoothly drawn from between the toner container 41 and the developing container 45 by the tape 64*a* attached to the surface of the elastic sealing member 64.

In the present embodiment, polystyrene is used as a material for forming the toner container 41 and the developing container 45. However, an ABS resin (acrylonitrile-butadiene-styrene copolymer), polycarbonate, polyethylene, or the like may be used.

Next, the configurations of the toner seal 60 and the seal grip 61 will be described in detail with reference to FIGS. 6A to 6C.

FIG. 6B shows a partially enlarged cross-section of the encircled portion designated by the reference sign C of the seal grip 61 in FIG. 6A. A protruded portion 41*p* is provided at the end portion 41*g* of the toner container 41 (developer container main body) in the longitudinal direction. The seal grip 61 is integrally formed by two-color molding using two resin materials having low compatibility, so as to cover the protruded portion 41*p* by pinching it, embracing it or interdigitating it. Because of this configuration, the seal grip 61 can be separated from the toner container 41 only when being pulled in a direction indicated by the arrow A in FIG. 6C, and the seal grip 61 can resist in a direction indicated by the arrow B in FIG. 6A. Furthermore, an undercut portion 41*q* is provided at the protruded portion 41*p* in order for the seal grip 61 not to come off easily by vibration and shock produced during transportation.

As the material for the seal grip 61, a resin material having a shrinkage ratio larger than that of the toner container 41 is used. Due to the shrinkage during molding, the seal grip 61 adheres to the protruded portion 41*p* of the toner container 41. Because of this, a load capacity with respect to a force from the direction indicated by the arrow B in FIG. 6A can be obtained stably.

In the present embodiment, polypropylene (PP) is used as the material for the seal grip 61. However, there is no particular limit to the above combination, as long as the shrinkage ratio of the material for the seal grip 61 is larger than that of the toner container 41.

Figure 9B:
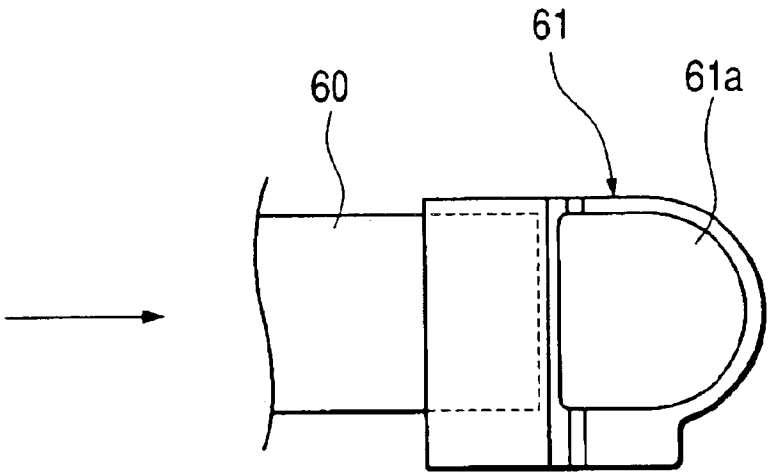
Figure 9A:
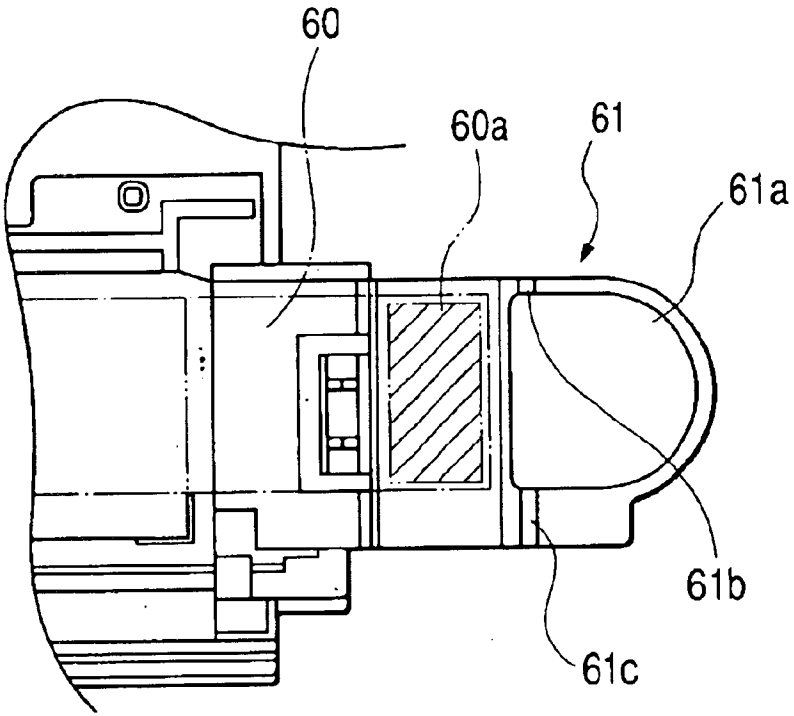

FIGS. 9A and 9B are plan views of the seal grip 61. The end portion 60*a* of the toner seal 60 is fixed to a region of a reverse surface of the seal grip 61 represented by hatching (FIG. 9A) with a pressure sensitive adhesive double coated tape, welding, or the like. When the seal grip 61 is pulled out in the longitudinal direction of the toner container 41, the seal grip 61 is separated from the toner container 41 and the toner seal 60 is opened, as shown in FIG. 9B, whereby the toner in the toner container 41 can be supplied to the developing container 45. The seal grip 61 is provided with a hole 61*a* for inserting a finger, having a ring shape so as to facilitate a pull operation.

Furthermore, thin portions 61*b* and 61*c* are provided in the lateral direction of the seal grip 61. Thus, when the process cartridge 7 is packed for delivery and transportation, the seal grip 61 can be folded from the thin portions 61*b* and 61*c*. By designing the seal grip 61 so as to be deformed as described above, a package member can be reduced in dimension without impairing the ease of pulling the seal grip 61.

Figure 10:
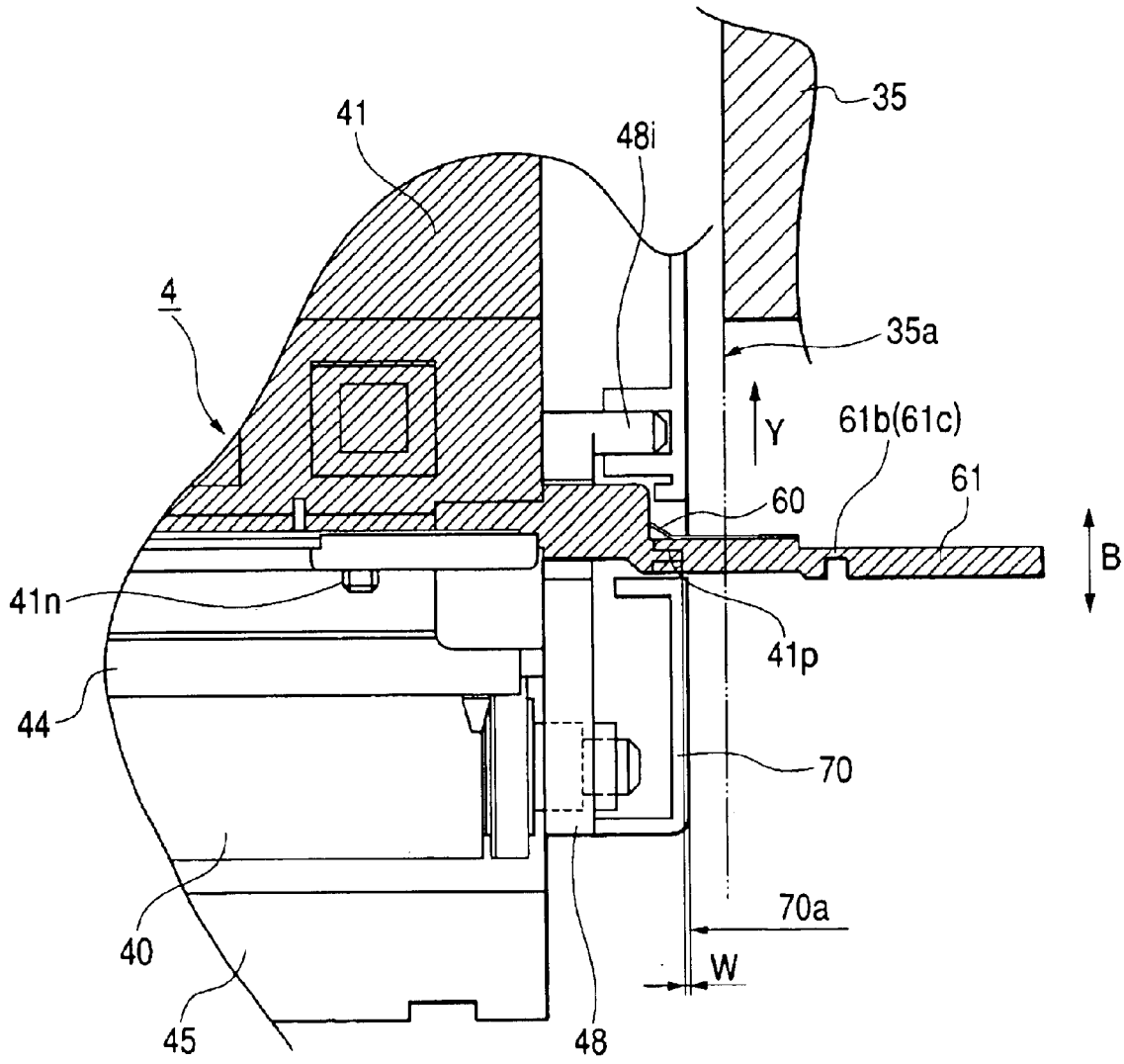
FIG. 10 is a cross-sectional view showing a connection portion between a toner container and a seal grip.

Herein, as shown in FIG. 10, the tip end of the protruded portion 41*p* of the toner container 41 is substantially matched with the position of an end portion 70*a* in the longitudinal direction of a side cover 70. Alternatively, the tip end of the protruded portion 41*p* is placed slightly inside of the toner container 41 with respect to the end portion 70*a* in the longitudinal direction via a gap W. Furthermore, the position of the thin portions 61*b* and 61*c* of the seal grip 61 is substantially matched with a guide end face 35*a* in the longitudinal direction of the process cartridge guide 35 of the image forming apparatus or is placed outside in the longitudinal direction of the guide end face 35*a*. Therefore, when it is attempted to attach the process cartridge 7, with the seal grip 61 attached thereto, to the image forming apparatus main body 30 (when the process cartridge 7 is inserted in a direction indicated by the arrow Y in FIG. 10), the seal grip 61 passes over the process cartridge mounting region (developer container mounting region) of the image forming apparatus main body 30 to be hitched by the process cartridge guide 35. The seal grip 61 at this time does not come off or is not folded in a direction indicated by the arrow B in FIG. 10. Therefore, the process cartridge 7 cannot be inserted to the image forming apparatus main body 30 any more. Because of this, the process cartridge 7 can be prevented from being mounted to the image forming apparatus main body 30 under the condition that the seal grip 61 is not removed, i.e., the toner has not been supplied from the toner container 41 to the developing container 45 and the process cartridge 7 cannot be used.

On the other hand, under the condition that the seal grip 61 is removed together with the toner seal 60, there is no portion for preventing the mounting of the process cartridge 7 to the image forming apparatus main body 30. Therefore, smooth mounting is made possible.

The tip end position of the protruded portion 41*p* of the toner container 41 is appropriately varied depending upon the shape of the process cartridge 7 and the shape of the process cartridge guide 35. The same effect can be obtained even if the tip end position is varied.

In the present embodiment, for example, the toner container 41 has a black color and the seal grip 61 has an orange color. The reason for this is to allow a user to easily discriminate the seal grip 61 by setting the main body of the toner container 41 and the seal grip 61 so as to have different colors. The color combination between the main body of the toner container 41 and the seal grip 61 can be arbitrarily determined, and there is no particular limit to the above combination.

Furthermore, even in the toner container 41 configuration shown in FIGS. 11A and 11B, the toner seal 10 and the seal grip 61 can have the same configuration.

(Embodiment 2)

Figure 12:
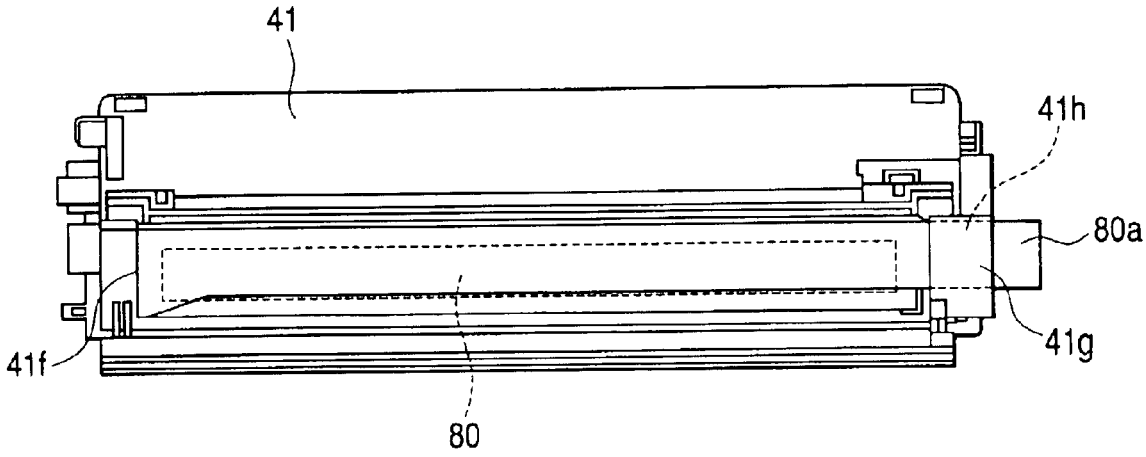
FIG. 12 is an elevation view showing a toner container according to a second embodiment.
Figure 13:
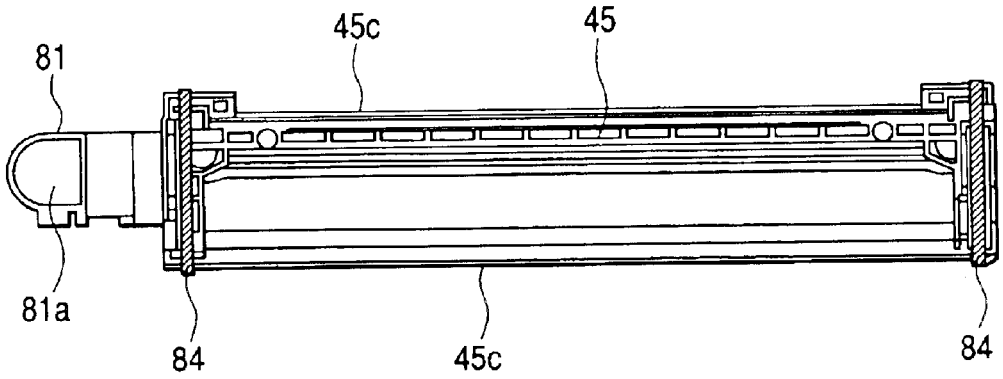
FIG. 13 is an elevation view showing a developing container according to the second embodiment of the invention.
Figure 14:
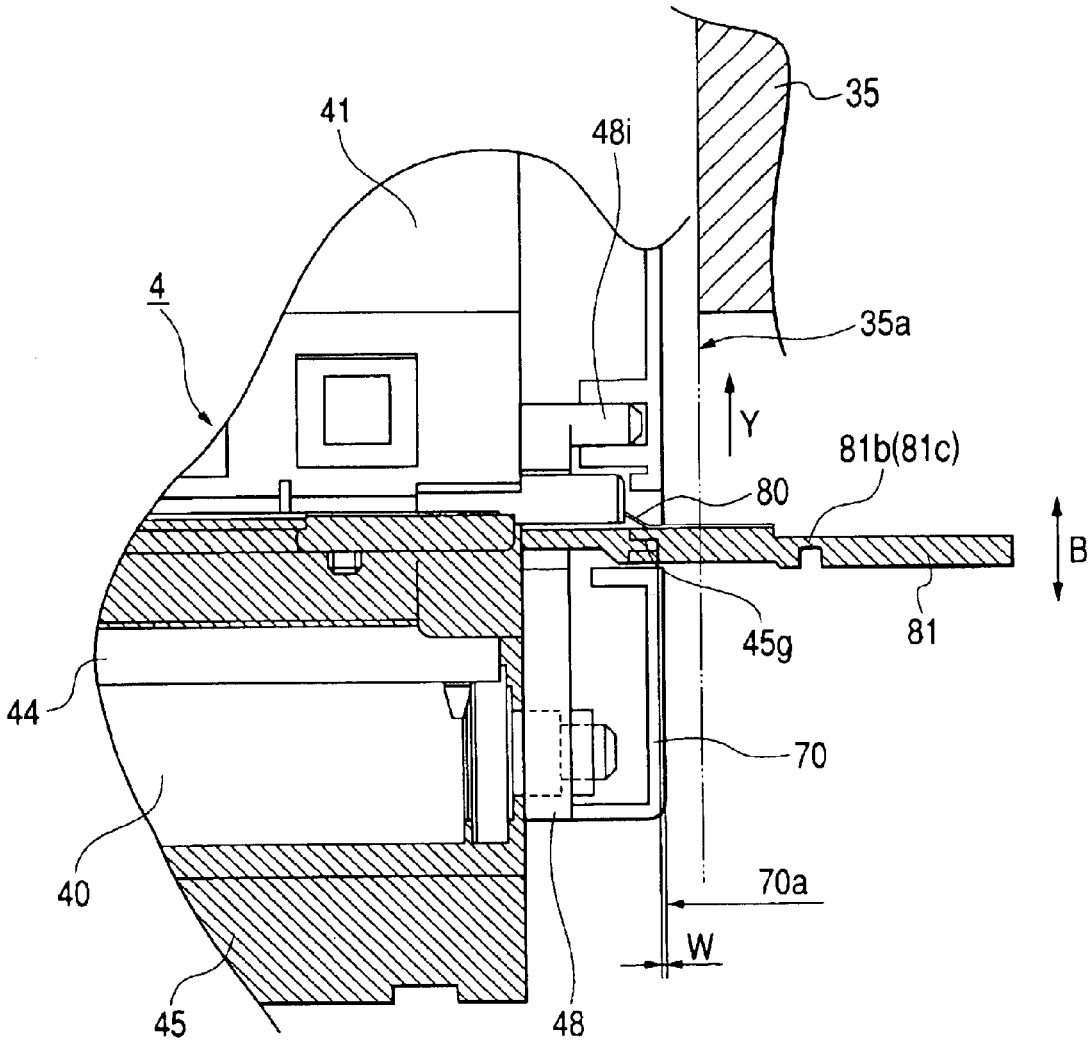
FIG. 14 is a cross-sectional view showing a connection portion between a developing container and a seal grip according to the second embodiment of the invention.

FIGS. 12 to 14 show a second embodiment. The schematic configuration of the image forming apparatus, and the configurations of the process cartridge 7, the image forming apparatus main body 30, the process cartridge guide 35, the toner container 41, the opening 41*a*, the toner seal welding surface 41*b*, the flange portions 41*c* and 41*d*, the thread groove 4*e*, the developing container 45, and the like are the same as those in the first embodiment. Therefore, the same components as those in the first embodiment are denoted with the same reference numerals as those therein, and the description thereof will be omitted here.

As shown in FIG. 12, a toner seal 80 is attached to the welding surface 41*b* so as to seal the opening 41*a* of the toner container 41 by welding or the like. The toner seal 80 is folded at the end portion 41*f* of the opening 41*a* in the longitudinal direction, and thereafter, is drawn outside through the hollow portion 41*h* of the other end portion 41*g* of the toner container 41.

Furthermore, a cap member (not shown) made of a material having a satisfactory sliding property and flexibility (for example, elastomer rubber) is inserted to the hollow portion 41*h* of the toner container 41. The toner seal 80 is sandwiched between the wall surface of the hollow portion 41*h* of the toner container 41 and the cap member.

FIG. 13 shows the developing container 45 in a state inverted from the right to the left. A seal grip 81 is integrally molded with the developing container 45 by two-color molding in the same way as in Embodiment 1 at the position of the developing container 45 opposed to a portion from which the toner seal 80 is extended out. More specifically, two-color molding is performed so that the protruded portion 45*g* is provided at the end portion of the developing container 45 constituting the developing container main body, and the seal grip 81 covers the protruded portion 45*g*. Furthermore, the same combination and the same material as that in the first embodiment is used (see FIG. 14).

An elastic sealing member 84 such as urethane foam and expanded rubber is attached to portions of the developing container 45 opposed to the end portions 41*f* and 41 g of the toner container 41 in the longitudinal direction in the same way as the above embodiment. Alternatively, portions of the developing container 45 are coated with the elastic sealing member 84.

The toner container 41 and the developing container 45 are connected to each other in the same way as in the first embodiment.

The toner container 41 and the developing container 45 are connected to each other. Thereafter, the end portion 80*a* of the toner seal 80 is fixed to an adjacent region of a hole 81*a* of the seal grip 81 on the developing container 45 side by a pressure sensitive adhesive double coated tape, welding, or the like. Thus, a unit of the toner container 41 and the developing container 45 is completed.

In the same way as in the first embodiment, as the toner seal 80, there is a combination of a cover film for sealing the opening 41*a* of the toner container 41 and the tear tape for tearing the cover film, in addition to the above-mentioned easy peel type using one folded sheet. The present invention is applicable to any of these toner seals.

In order to send the toner contained in the toner container 41 to the developing, container 45 so that the process cartridge 7 is made usable, the seal grip 81 having a longitudinal dimension extending to the developing container mounting region and the process cartridge mounting region of the image forming apparatus and projecting outside of the process cartridge 7 is pulled, whereby the toner seal 80 is drawn out. Because of this, the opening 41*a* of the toner container 41 is opened, and the toner can be sent from the toner container 41 to the developing container 45, i.e., the usable state of the process cartridge 7 is obtained. At this time, the cap member (not shown) adheres to the wall surface of the hollow portion 41*h* of the toner container 41 after the toner seal 80 is pulled out, thereby preventing the toner from leaking outside.

In the present embodiment, polystyrene is used as a material for the developing container 45. However, an ABS resin (acrylonitrile-butadiene-styrene copolymer), polycarbonate, polyethylene, or the like may be used. Furthermore, polypropylene (PP) is used as the material for the seal grip 81. The same effect can be obtained as long as the material has a shrinkage ratio during molding larger than that of the main body of the developing container 45, as described above. Therefore, there is no particular limit to the above combination. Furthermore, the shape of the seal grip 81 is the same as that in the first embodiment.

Furthermore, the configuration of the opposed surface of the toner container 41 and the developing container 45 may be the same as that in FIGS. 11A and 11B.

Herein, as shown in FIG. 14, the tip end of the protruded portion 45*g* of the developing container 45 is substantially matched with an end portion 70*a* in the longitudinal direction of a side cover 70. Alternatively, the tip end of the protruded portion 41*p* is placed slightly inside of the container with respect to the end portion 70*a* in the longitudinal direction via a gap W. Furthermore, the position of the thin portions 81*b* and 81*c* of the seal grip 81 is substantially matched with a guide end face 35*a* in the longitudinal direction of the process cartridge guide 35 of the image forming apparatus or is placed outside in the longitudinal direction of the guide end face 35*a*. Therefore, when it is attempted to mount the process cartridge 7, with the seal grip 81 attached thereto, to the image forming apparatus main body 30 (when the process cartridge 7 is inserted in a direction indicated by the arrow Y in FIG. 14), the seal grip 81 is hitched by the process cartridge guide 35. The seal grip 81 at this time does not come off in a direction indicated by the arrow B in FIG. 14. Therefore, the process cartridge 7 cannot be inserted to the image forming apparatus main body 30 any more. Because of this, the process cartridge 7 can be prevented from being mounted to the image forming apparatus main body 30 under the condition that the seal grip 81 is not removed, i.e., the toner has not been supplied from the toner container 41 to the developing container 45 and the process cartridge 7 cannot be used.

On the other hand, under the condition that the seal grip 81 is removed, there is no portion for preventing the mounting of the process cartridge 7 to the image forming apparatus main body 30. Therefore, smooth mounting is made possible.

The tip end position of the protruded portion 45*g* of the developing container 45 is appropriately varied depending upon the shape of the process cartridge 7 and the shape of the process cartridge guide 35. The same effect can be obtained even if the tip end position is varied.

In the same way as in the first embodiment, the color combination between the main body of the developing container 45 and the seal grip 81 can be arbitrarily determined, and there is no particular limit to the above combination.

(Embodiment 3)

Figure 15:
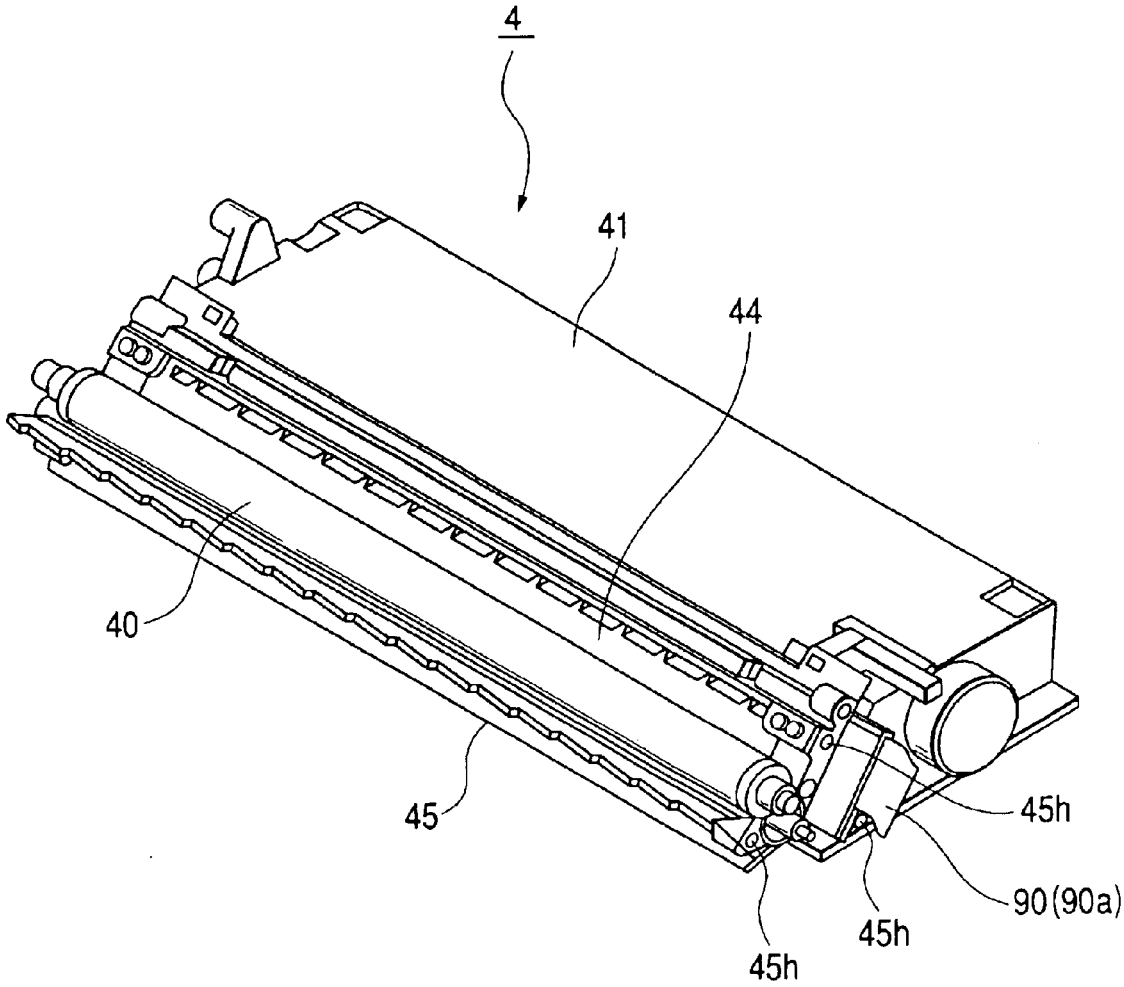
FIG. 15 is a perspective view showing a developing apparatus according to a third embodiment of the invention.
Figure 16A:
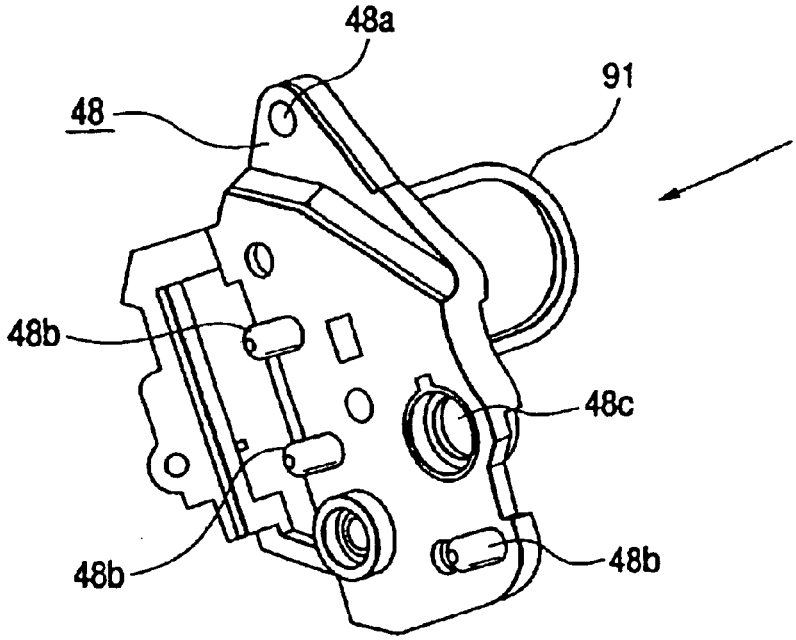
FIGS. 16A and 16B illustrate a bearing member and a seal grip according to the third embodiment of the invention.
Figure 16B:
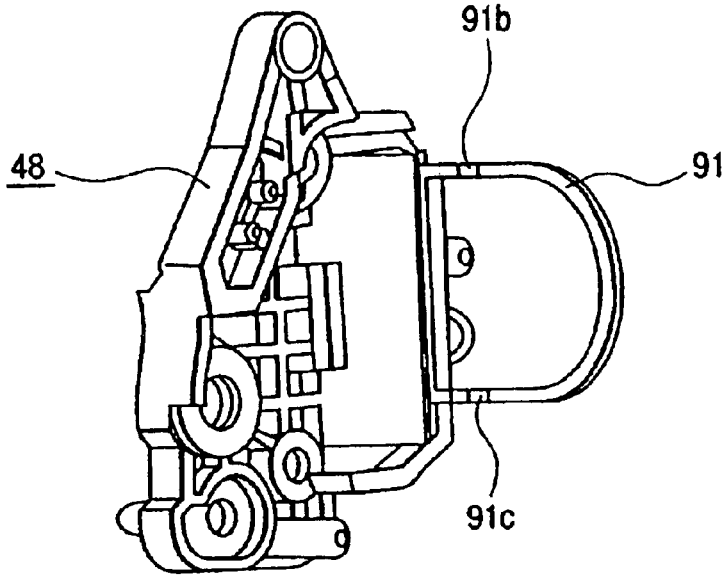
Figure 17:
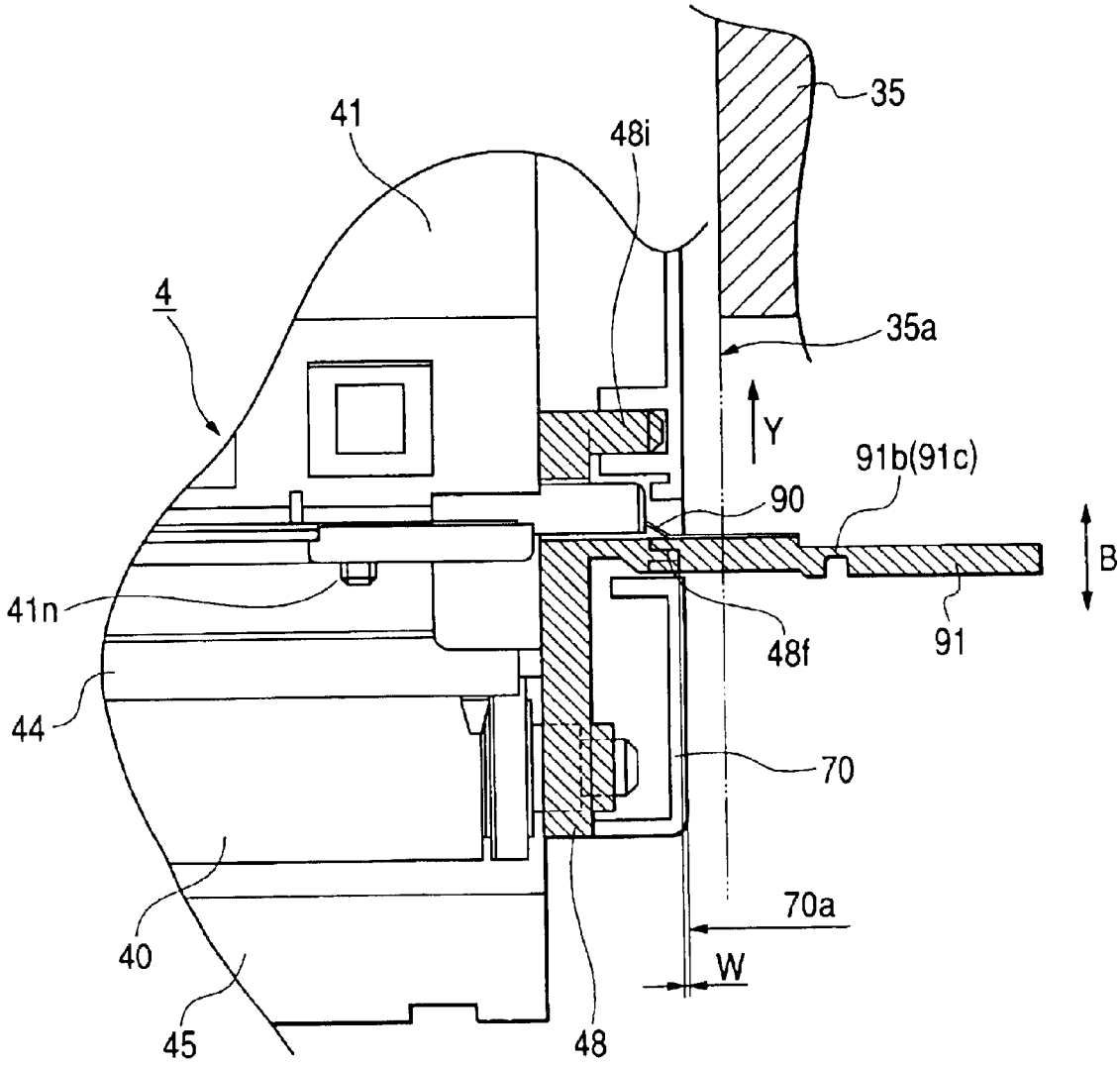
FIG. 17 is a cross-sectional view showing a connection portion between the bearing member and the seal grip according to the third embodiment of the invention.
Figure 18:
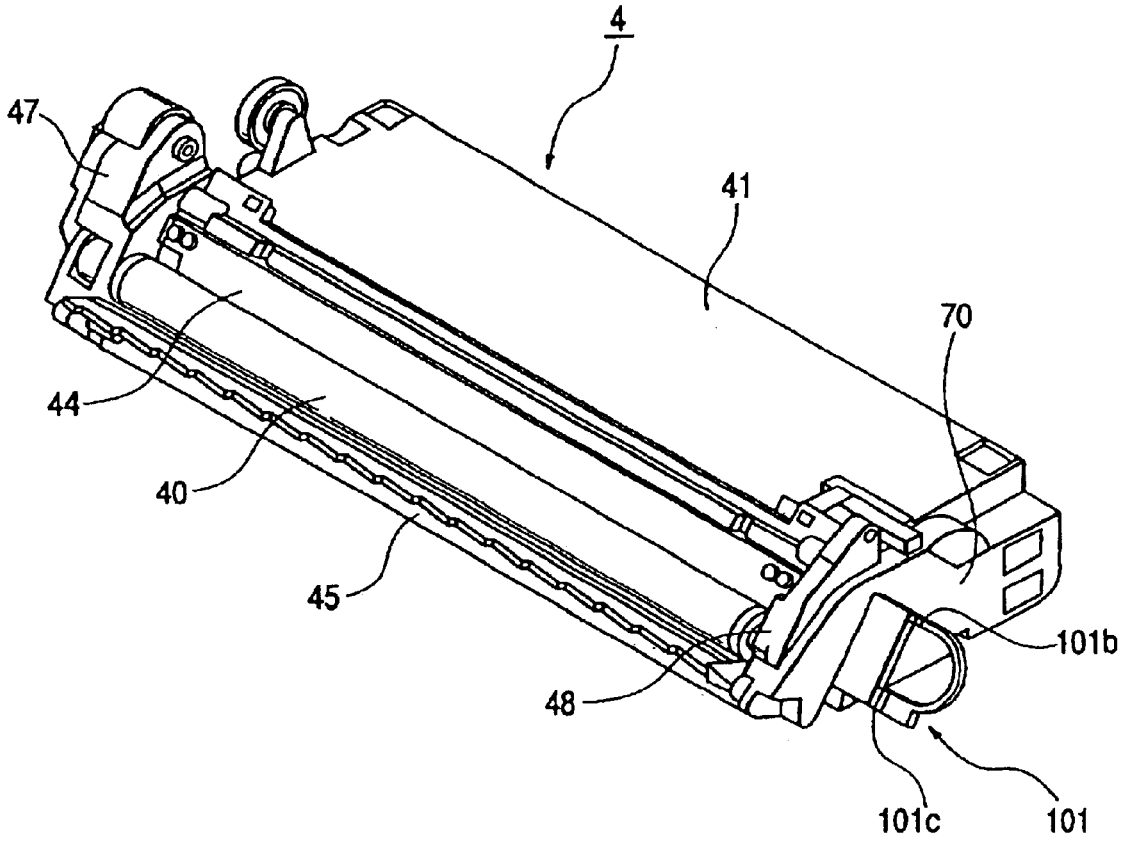
FIG. 18 is a perspective view showing a developing device according to a fourth embodiment of the invention.

FIGS. 15 to 17 show a third embodiment. The schematic configuration of the image forming apparatus, and the configurations of the process cartridge 7, the image forming apparatus main body 30, the process cartridge guide 35, the toner container 41, the developing container 45, the developing blade 44, the developing roller 40, the bearing member 48, and the like are the same as those in the first embodiment. Therefore, the same components as those in the first embodiment are denoted with the same reference numerals as those therein, and the description thereof will be omitted here.

In the same way as in the first embodiment, a toner seal 90 is attached to the welding surface 41*b* of the toner container 41 so as to seal the opening 41*a* of the toner container 41 by welding or the like. The toner seal 90 is folded at the end portion 41*f* of the opening 41*a* in the longitudinal direction, and is extended outside through the hollow portion 41*h* of the other end portion 41*g* of the toner container 41.

Furthermore, a cap member 63 made of a material having a satisfactory sliding property and flexibility (for example, elastomer rubber) is inserted to the hollow portion 41*h* of the toner container 41. The toner seal 90 is sandwiched between the wall surface 41*j* of the hollow portion 41*h* of the toner container 41 and the cap member 63.

Furthermore, an elastic sealing member 64 such as urethane foam and expanded rubber is attached to end portions 45*i* and 45*j* of the developing container 45 in the longitudinal direction of a flat surface opposed to the toner container 41. Alternatively, the end portions 45*i* and 45*j* are coated with the elastic sealing member 64. The position of the elastic sealing member 64 is matched with the end portions 41*f* and 41*g* of the toner container 41 in the longitudinal direction. The elastic sealing member 64 extends over the entire width in the lateral direction, and is overlapped with the protruded thread 45*c*.

FIGS. 16A and 16B show a configuration of a bearing including one bearing member 48 for rotatably supporting the developing roller 40. The bearing member 48 is provided with a connection portion 48*a* with respect to the photosensitive drum unit 5, a boss 48*b* for positioning with respect to the developing container 45, and a bearing portion 48*c* for rotatably supporting the developing roller 40 (developer bearing member).

As shown in FIG. 15, the developing blade 44 and the like are previously incorporated into the developing container 45. Under this condition, a positioning hole 45*h* of the developing container 45 is fitted onto a positioning boss 48*b* of the bearing member 48 while the developing roller 40 is aligned with the bearing portion 48*c* of the bearing member 48, whereby the developing container 45 is fixed with a screw.

As shown in FIGS. 16A and 16B, a seal grip 91 is integrally molded with a portion of the bearing member 48 positioned in the vicinity of an end portion 90*a* of a toner seal 90. After the bearing member 48 is incorporated into the developing container 45, the end portion 90*a* of the toner seal 90 is fixed by a fixing method such as a pressure sensitive adhesive double coated tape, welding, or the like, whereby incorporation of the toner seal 90 into the seal grip 91 is completed.

The configuration of the toner seal 90 is the same as that of the first embodiment.

In order to send the toner contained in the toner container 41 to the developing container 45 so that the process cartridge 7 is made usable, the seal grip 91 projecting outside of the process cartridge 7 is pulled, whereby the toner seal 90 is drawn out. Because of this, the opening of the toner container 41 is opened, and the toner can be sent from the toner container 41 to the developing container 45, i.e., the usable state of the process cartridge 7 is obtained.

Herein, as the material for the seal grip 91, a material having a shrinkage ratio larger than that of the bearing member 48 is used. Due to the shrinkage during molding, the seal grip 91 adheres to the protruded portion 48*f* (see FIG. 17) of the bearing member 48. Because of this, a load capacity with respect to a force from the direction indicated by the arrow B in FIG. 17 can be obtained stably.

In the present embodiment, polycarbonate (PC) or polystyrene (PS) is used as the material for the bearing member 48, and polypropylene (PP) is used as the material for the seal grip 91. However, there is no particular limit to the above combination, as long as the shrinkage ratio of the material for the seal grip 91 is larger than that of the bearing member 48.

Furthermore, the configuration of the opposed surface of the toner container 41 and the developing container 45 may be the same as that in FIGS. 11A and 11B.

Herein, as shown in FIG. 17, the tip end of the protruded portion 48*f* of the bearing member 48 is substantially matched with an end portion 70*a* in the longitudinal direction of a side cover 70. Alternatively, the tip end of the protruded portion 48*f* is placed slightly inside of the toner container 41 with respect to the end portion 70*a* in the longitudinal direction via a gap W. Furthermore, the position of the thin portions 91*b* and 91*c* of the seal grip 91 is substantially matched with a guide end face 35*a* in the longitudinal direction of the process cartridge guide 35 of the image forming apparatus main body 30 or is placed outside in the longitudinal direction of the guide end face 35*a*. Therefore, when it is attempted to mount the process cartridge 7, with the seal grip 91 attached thereto, to the image forming apparatus main body 30 (when the process cartridge 7 is inserted in a direction indicated by the arrow Y in FIG. 17), the seal grip 91 is hitched by the process cartridge guide 35. The seal grip 91 at this time does not come off in a direction indicated by the arrow B in FIG. 17. Therefore, the process cartridge 7 cannot be inserted to the image forming apparatus main body 30 any more. Because of this, the process cartridge 7 can be prevented from being mounted to the image forming apparatus main body 30 under the condition that the seal grip 91 is not removed, i.e., the toner has not been supplied from the toner container 41 to the developing container 45 and the process cartridge 7 cannot be used.

On the other hand, under the condition that the seal grip 91 is removed, there is no portion for preventing the mounting of the process cartridge 7 to the image forming apparatus main body 30. Therefore, smooth mounting is made possible.

The tip end position of the protruded portion 48*f* of the bearing member 48 is appropriately varied depending upon the shape of the process cartridge 7 and the shape of the process cartridge guide 35. The same effect can be obtained even if the tip end position is varied.

In the present embodiment, the toner container 41, the developing container 45, the side cover 70, and the bearing member 48, constituting the developing device main body, have a black color. However, the seal grip 91 provided at the bearing member 48 has an orange color. The reason for this is to allow a user to easily discriminate the seal grip 91 by setting the developing device main body and the seal grip 91 so as to have different colors. The color combination among the toner container 41, the developing container 45, the side cover 70, the bearing member 48, and the seal grip 91 constituting the developing device 4 can be arbitrarily determined, and there is no particular limit to the above combination.

(Embodiment 4) 1

FIGS. 18 to 21 show a fourth embodiment. The schematic configuration of the image forming apparatus, and the configurations of the process cartridge 7, the image forming apparatus main body 30, the process cartridge guide 35, the toner container 41, the developing container 45, the side cover 70, and the like are the same as those in the first embodiment. Therefore, the same components as those in the first embodiment are denoted with the same reference numerals as those therein, and the description thereof will be omitted here.

Furthermore, the attachment and handling of a toner seal 100, and the connection procedure of the toner container 41 and the developing container 45 shown in FIG. 21 are the same as those in the first embodiment.

Figure 20A:
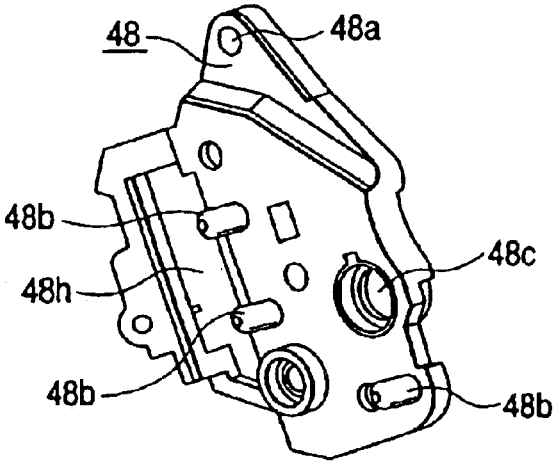
FIGS. 20A and 20B illustrate a bearing member according to a fourth embodiment of the invention.
Figure 20B:
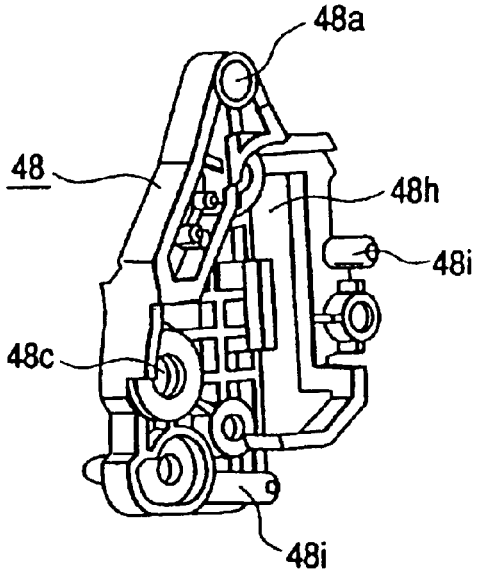

A method for attaching the bearing member 48 and the side cover 70 to the developing container 45 will be described. As shown in FIGS. 20A and 20B, the bearing member 48 of the present embodiment is provided with a connection portion 48*a* with respect to the photosensitive drum unit 5, positioning bosses 48*b* for positioning with respect to the developing container 45, and a bearing portion 48*c* for rotatably supporting the developing roller 40.

Furthermore, the developing blade 44 and the like are previously incorporated into the developing container 45. Under this condition, the positioning hole 45*h* of the developing container 45 is fitted onto one of the positioning bosses 48*b* of the bearing member 48 while the developing roller 40 is aligned with the bearing portion 48*c* of the bearing member 48, whereby the developing container 45 is fixed with a screw. At this time, the end portion of the toner seal 100 is passed through a rectangular hole 48*h* provided in the bearing member 48.

The side cover 70 is attached to the bearing member 48 with a screw under the condition that a positioning boss 48*i* of the bearing member 48 is aligned with the positioning hole 70*b* of the side cover 70, as shown in FIG. 21, after the bearing member 48 is attached to the developing container 45. At this time, the end portion of the toner seal 100 is passed through the rectangular hole 70*c* provided on the side cover 70 (see FIG. 19).

Herein, a seal grip 101 is provided integrally with the side cover 70 in the vicinity of the end portion of the toner seal 100. After the side cover 70 is incorporated into the bearing member 48, the end portion of the toner seal 100 is fixed to the seal grip 101 by a fixing method such as a pressure sensitive adhesive double coated tape, welding, or the like, whereby incorporation of the toner seal 100 into the seal grip 101 is completed.

The configuration of the toner seal 100 is the same as that of the first embodiment.

In order to send the toner contained in the toner container 41 to the developing container 45 so that the process cartridge 7 is made usable, the seal grip 101 projecting outside of the process cartridge 7 is pulled, whereby the toner seal 100 is drawn out. Because of this, the opening 41*a* of the toner container 41 is opened, and the toner can be sent from the toner container 41 to the developing container 45, i.e., the usable state of the process cartridge 7 is obtained.

Herein as the material for the seal grip 101, a material having a shrinkage ratio larger than that of the main body of the side cover 70 is used. Due to the shrinkage during molding, the seal grip 101 shown in FIG. 21 adheres to the protruded portion 70*d* of the side cover 70. Because of this, a load capacity with respect to a force from the direction indicated by the arrow B in FIG. 21 can be obtained stably. In the present embodiment, polystyrene (PS) is used as the material for the side cover 70, and polypropylene (PP) is used as the material for the seal grip 101. However, there is no particular limit to the above combination, as long as the shrinkage ratio of the material for the seal grip 101 is larger than that of the main body of the side cover 70.

Furthermore, the configuration of the opposed surface of the toner container 41 and the developing container 45 may be the same as that in FIGS. 11A and 11B.

Herein, as shown in FIG. 21, the tip end of the protruded portion 70*d* of the side cover 70 is substantially matched with an end portion 70*a* in the longitudinal direction of a side cover 70. Alternatively, the tip end of the protruded portion 70*d* is placed slightly inside of the toner container 41 with respect to the end portion 70*a* in the longitudinal direction via a gap W. Furthermore, the position of thin portions 101*b* and 101*c* of the seal grip 101 in the longitudinal direction is substantially matched with a guide end face 35*a* in the longitudinal direction of the process cartridge guide 35 of the image forming apparatus main body 30 or is placed outside in the longitudinal direction of the guide end face 35*a*. Therefore, when it is attempted to mount the process cartridge 7, with the seal grip 101 attached thereto, to the image forming apparatus main body 30 (when the process cartridge 7 is inserted in a direction indicated by the arrow Y in FIG. 21), the seal grip 101 is hitched by the process cartridge guide 35. The seal grip 101 at this time does not come off in a direction indicated by the arrow B in FIG. 21. Therefore, the process cartridge 7 cannot be inserted to the image forming apparatus main body 30 any more. Because of this, the process cartridge 7 can be prevented from being attached to the image forming apparatus main body 30 under the condition that the seal grip 101 is not removed, i.e., the toner has not been supplied from the toner container 41 to the developing container 45 and the process cartridge 7 cannot be used.

On the other hand, under the condition that the seal grip 101 is removed, there is no portion for preventing the mounting of the process cartridge 7 to the image forming apparatus main body 30. Therefore, smooth mounting is made possible.

The tip end position of the protruded portion 70*d* of the side cover 70 is appropriately varied depending upon the shape of the process cartridge 7 and the shape of the process cartridge guide 35. The same effect can be obtained even if the tip end position is varied.

In the present embodiment, the toner container 41, the developing container 45, the bearing member 48, and the main body of the side cover 70, constituting the developing device main body, have a black color. However, the seal grip 101 provided at the side cover 70 has an orange color. The reason for this is to allow a user to easily discriminate the seal grip 101 by setting the developing device main body and the seal grip 101 so as to have different colors. The color combination among the toner container 41, the developing container 45, the bearing member 48, the side cover 70, and the seal grip 101 constituting the developing device main body can be arbitrarily determined, and there is no particular limit to the above combination.

(Embodiment 5)

Figure 22A:
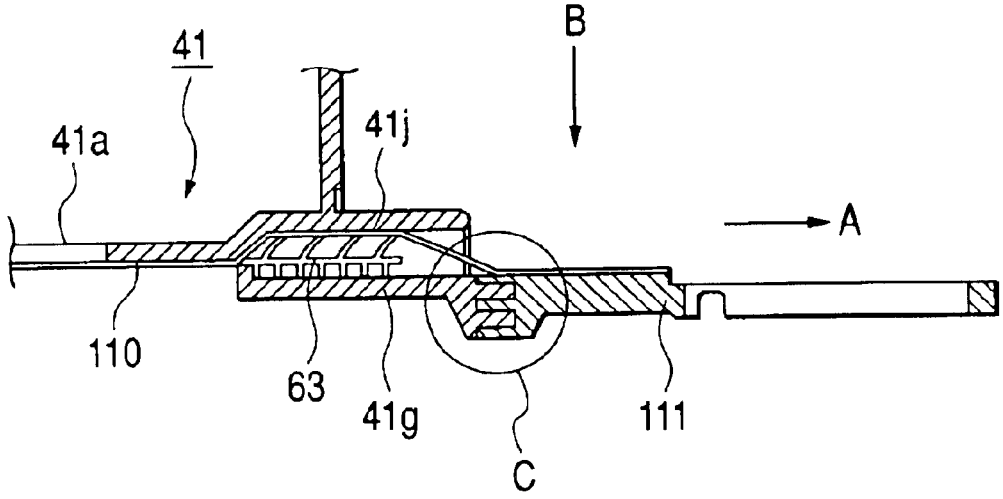
FIGS. 22A and 22B illustrate a connection portion between a toner container and a seal grip according to a fifth embodiment of the invention.
Figure 22B:
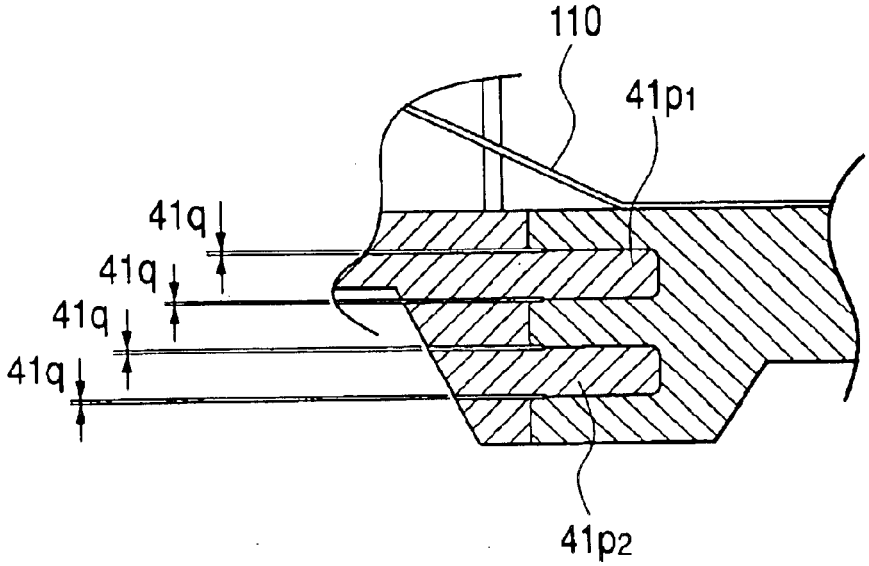

FIGS. 22A and 22B show a fifth embodiment. The configurations of the toner container 41, the opening 41*a*, the cap member 63, and the like are the same as those in the first embodiment. Therefore, the description thereof will be omitted here.

FIG. 22B shows a partially enlarged view of a seal grip 111 with the end portion of a toner seal 110 connected thereto according the present embodiment. As shown in FIG. 22B, plural protruded portions 41*p*1 and 42*p*2 similar to the protruded portion 41*p* of the toner container 41 shown in FIGS. 6A, 6B, and 6C are arranged, and the seal grip 111 is integrally molded by two-color molding so as to cover the protruded portions 41*p*1 and 42*p*2.

Because of this configuration, the seal grip 111 can be separated from the toner container 41 only when being pulled in a direction indicated by the arrow A in FIG. 22A, and can resist in a direction indicated by the arrow B in FIG. 22A with a large force. Furthermore, undercut portions 41*q* are provided at the respective protruded portions 41*p*1 and 41*p*2, whereby the seal grip 11 is prevented from easily coming off due to vibration and shock occurring during transportation or the like.

Further, as the material for the seal grip 111, a material having a shrinkage ratio larger than that of the toner container 41 is used. Due to the shrinkage during molding, the seal grip 111 adheres to the protruded portions 41*p* 1 and 41*p*2 of the toner container 41. Because of this, a load capacity with respect to a force from the direction indicated by the arrow B in FIG. 22A can be obtained stably.

In the present embodiment, polypropylene (PP) is used as the material for the seal grip 111. However, there is no particular limit to the above combination, as long as the shrinkage ratio of the material for the seal grip 111 is larger than that of the toner container 41.

The present embodiment is applicable not only to the case where the seal grip 111 is provided at the toner container 41 as shown in FIG. 22A, but also to the case where the seal grip 81 is provided at the developing container 45 described in Embodiment 2, the case where the seal grip 91 is provided at the bearing member 48 as described in Embodiment 3, or the case where the seal grip 101 is provided at the side cover 70 as described in Embodiment 4.

According to the above-mentioned embodiment, the opening 41*a* of the toner container 41 is sealed with a toner seal or sealing member so that a developer does not leak before the process cartridge 7 is mounted to the image forming apparatus main body 30. Immediately before the process cartridge 7 is mounted to the image forming apparatus main body 30, the seal grip or grip member 111 connected to one end of the sealing member 110 is pulled in the longitudinal direction to open the opening 41*a*, whereby the developer can be supplied from the toner container 41 to the developing container 45.

The grip member 111 of the sealing member 110 is integrally molded so as to be separable, using a resin material having low compatibility with respect to the toner container 41, the developing container 45, the bearing member 48 of the developing roller 40 of the developing device 4, the side cover 71, and the like. The grip member 111 is separated from the toner container 41 main body and the like by a pull operation of the grip member 111 for pulling out the sealing member 110. The sealing member 110 is designed so as to be drawn out in the longitudinal direction. Accordingly, the number of components can be reduced, and the production processes can be simplified without impairing the efficiency of the operation of removing a sealing member 110.

Furthermore, the grip member 111 of the sealing member 110 having a different color from that of the toner container 41 and the like can be simultaneously molded by so-called two-color molding. Therefore, the process of producing the grip member 111 discriminable by the color as a separate component can be omitted. Thus, the cost of the image forming apparatus can be greatly reduced by the reduction in number of production processes.

Furthermore, the outer dimension of the grip member 111 extends outside of the toner container 41 in the longitudinal direction. The process cartridge 7 cannot be mounted to the image forming apparatus main body 30 unless the opening 41*a* is opened by pulling the grip member 111. Therefore, an operation error of mounting the process cartridge 7 without opening the opening 41*a* can be prevented, and damage and the like caused by the carelessness of a user can be avoided.

As described above, the opening 41*a* of the toner container 41 is sealed with the toner seal 110; the seal grip 111 is pulled out at the commencement of use to pull out the toner seal 110 in the longitudinal direction of the process cartridge 7. Furthermore, the seal grip 111 is placed so as to be outside of the width of a guide in the longitudinal direction of the process cartridge 7, which guide is for mounting/detaching the process cartridge 7 to the image forming apparatus main body. Thus, the process cartridge 7 can be prevented from being mounted to the image forming apparatus main body 30 under the condition that the seal grip 111 is not removed. Furthermore, the toner container 41, the developing container 45, the bearing member 48 or the side cover 70, and the seal grip 111 are integrally molded by two-color molding with materials having low compatibility. Thus, while the number of components and the number of assembly processes are reduced, the dimension of the engagement portion between the toner container 41, the developing container 45, the bearing member 48 or the side cover 70, and the seal grip 111 can be obtained stably. Therefore, the seal grip can be prevented from coming off due to the vibration during transportation, while the force of pulling the seal grip 111 is reduced. Furthermore, by subjecting the seal grip 111 to two-color molding, the color of the seal grip 111 can be arbitrarily set, and a user can easily discriminate the portion to be removed with a color when using the process cartridge 7.

According to the present invention, the number of components can be reduced. Furthermore, according to the present invention, the process cartridge 7 cannot be mounted to the image forming apparatus main body 30 unless the seal grip 111 is removed, whereby mounting operability is enhanced.

While the invention has been described with reference to the structure disclosed herein, it is not confined to the details set forth and this application is intended to cover such modifications or changes as may come within the purposes of the improvements or the scope of the following claims.

What is claimed is:

1. A developer container of a developing device to be mounted to an image forming apparatus having a developer-container mounting region, said developer container comprising:

a developer container main body having a developer supply opening and comprising a developer containing portion configured to contain a developer;

a sealing member configured and positioned to seal the developer supply opening of said developer container main body; and a grip member configured and positioned to pull out said sealing member in a longitudinal direction of said developer container main body, wherein said developer container main body and said grip member are integrally molded from resin materials having low compatibility to be separable from each other, and wherein said grip member has a longitudinal dimension extending outside of the developer-container mounting region of the image forming apparatus in order to prevent said developer container from mounting to the image forming apparatus by abutting said grip member against the developer-container mounting region when said developer container is to be mounted to the image forming apparatus without pulling out said sealing member.

2. A developer container according to claim 1, wherein the resin material forming said grip member has a shrinkage ratio larger than that of the resin material forming said developer container main body.

3. A developer container according to claim 1 or 2, wherein said developer container main body comprises a protruded portion pinchable by or interdigitated with said grip member.

4. A developer container according to claim 3, wherein said protruded portion comprises an undercut portion.

5. A developer container according to claim 4, further comprising a plurality of protruded portions arranged on said developer container main body.

6. A developer container according to claim 5, wherein said developer container main body and said grip member are two-color molded from two resin materials having different colors so that said developer container main body and said grip member are of different colors.

7. A developer container according to claim 6, wherein said grip member has a ring shape.

8. A developer container according to claim 7, wherein said grip member has a thin portion facilitating deformation thereof.

9. A developing device comprising:

said developer container as set forth in claim 1; and means for developing a latent image formed on an electrophotographic photosensitive member with the developer stored in said developer container.

10. An image forming apparatus having a developer-container mounting region and comprising:

an image forming apparatus main body to which a developing device having said developer container as set forth in claim 1 and an electrophotographic photosensitive member are mounted.

11. A process cartridge detachably mountable to a process-cartridge mounting region of an image forming apparatus, said process cartridge comprising:

an electrophotographic photosensitive member; and a developing device comprising:

a developer container comprising:

a developer container main body having a developer supply opening and comprising a developer containing portion configured to contain a developer;

a sealing member configured and positioned to seal the developer supply opening of said developer container main body; and a grip member configured and positioned to pull out said sealing member in a longitudinal direction of said developer container main body, wherein said developer container main body and said grip member are integrally molded from resin materials having low compatibility to be separable from each other, and wherein said grip member has a longitudinal dimension extending outside of the process-cartridge mounting region of the image forming apparatus in order to prevent said process-cartridge from mounting to the image forming apparatus by abutting said grip member against the process-cartridge mounting region when said process cartridge is to be mounted to the image forming apparatus without pulling out said sealing member; and means for developing a latent image formed on said electrophotographic photosensitive member with the developer stored in said developer container.

12. A process cartridge according to claim 11, wherein the resin material forming said grip member has a shrinkage ratio larger than that of the resin material forming said developer container main body.

13. A process cartridge according to claim 11 or 12, wherein said developer container main body comprises a protruded portion pinchable by or interdigitated with said grip member.

14. A process cartridge according to claim 13, wherein said protruded portion comprises an undercut portion.

15. A process cartridge according to claim 14, further comprising a plurality of protruded portions arranged on said developer container main body.

16. A process cartridge according to claim 15, wherein said developer container main body and said grip member are two-color molded from two resin materials having different colors so that said developer container main body and said grip member are of different colors.

17. A process cartridge according to claim 16, wherein said grip member has a ring shape.

18. A process cartridge according to claim 17, wherein said grip member has a thin portion facilitating deformation thereof.

19. An image forming apparatus to which a process cartridge is detachably mountable for forming an image on a transfer material, said image forming apparatus comprising:

(i) a process-cartridge mounting region detachably mounting the process cartridge, the process cartridge comprising an electrophotographic photosensitive member, and a developing device, the developing device comprising a developer container and means for developing a latent image formed on the electrophotographic photosensitive member with a developer stored in the developer container, the developer container comprising a developer container main body having a developer supply opening and comprising a developer containing portion configured to contain the developer, a sealing member configured and positioned to seal the developer supply opening of the developer container main body, and a grip member configured and positioned to pull out the sealing member in a longitudinal direction of the developer container main body, wherein the developer container main body and the grip member are integrally molded from resin materials having low compatibility to be separable from each other, and wherein said process-cartridge mounting region is configured and sized so that the longitudinal dimension of the grip member extends outside of said process-cartridge mounting region in order to prevent the process cartridge from mounting to said image forming apparatus by abutting the grip member against said process-cartridge mounting region when the process cartridge is to be mounted to said image forming apparatus without pulling out the sealing member; and (ii) conveying means for conveying the transfer material.

20. A bearing structure of a developing device mountable to a developing-device mounting region of an image forming apparatus and that includes a developer container having a developer containing portion that contains a developer, a developer supply opening, and a sealing member that seals the developer supply opening, and a developer bearing member configured and positioned to act on an electrophotographic photosensitive member of the image forming apparatus, said bearing structure comprising:

a bearing member configured and positioned to rotatably support the developer bearing member; and a grip member configured and positioned to pull out the sealing member in a longitudinal direction of the developer container, wherein said bearing member and said grip member are integrally molded from resin materials having low compatibility to be separable from each other, and wherein said grip member has a longitudinal dimension extending outside of the developing device-mounting region of the image forming apparatus in order to prevent the developing device from mounting to the image forming apparatus by abutting said grip member against the developing-device mounting region when the developing device is to be mounted to the image forming apparatus without pulling out the sealing member.

21. A bearing structure according to claim 20, wherein the resin material forming said grip member has a shrinkage ratio larger than that of the resin material forming said bearing member.

22. A bearing structure according to claim 20 or 21, wherein said bearing member comprises a protruded portion pinched by or interdigitated with said grip member.

23. A bearing structure according to claim 22, wherein said protruded portion comprises an undercut portion.

24. A bearing structure according to claim 23, further comprising a plurality of protruded portions arranged on said bearing member.

25. A bearing structure according to claim 24, wherein said bearing member and said grip member are two-color molded from two resin materials having different colors so that said bearing member and said grip member are of different colors.

26. A bearing structure according to claim 25, wherein said grip member has a ring shape.

27. A bearing structure according to claim 26, wherein said grip member has a thin portion facilitating deformation thereof.

28. A side cover of a developing device mountable to a developing-device mounting region of an image forming apparatus and having a developer container that includes a developer containing portion configured to contain a developer, a developer supply opening, and a sealing member positioned and configured to seal the developer supply opening, said side cover comprising:

a side cover main body connected to a side surface of the developer container; and a grip member configured and positioned to pull out said sealing member in a longitudinal direction of the developer container, wherein said side cover main body and said grip member are integrally molded from resin materials having low compatibility to be separable from each other, and wherein said grip member has a longitudinal dimension extending outside of the developing-device mounting region of the image forming apparatus in order to prevent the developing device from mounting to the image forming apparatus by abutting said grip member against the developing-device mounting region when the developing device is to be mounted to the image forming apparatus without pulling out the sealing member.

29. A side cover according to claim 28, wherein the resin material forming said grip member has a shrinkage ratio larger than that of the resin material forming said side cover main body.

30. A side cover according to claim 28 or 29, wherein said side cover main body comprises a protruded portion pinched by or interdigitated with said grip member.

31. A side cover according to claim 30, wherein said protruded portion comprises an undercut portion.

32. A side cover according to claim 31, further comprising a plurality of protruded portions arranged on said side cover main body.

33. A side cover according to claim 32, wherein said side cover main body and said grip member are two-color molded from two resin materials having different colors so that said side cover main body and said grip member are of different colors.

34. A side cover according to claim 33, wherein said grip member has a ring shape.

35. A side cover according to claim 34, wherein said grip member has a thin portion facilitating deformation thereof.

* * * * *

UNITED STATES PATENT AND TRADEMARK OFFICE

CERTIFICATE OF CORRECTION

PATENT NO. : 6,834,171 B2
DATED : December 21, 2004
INVENTOR(S) : Nittani et al.

Figure 19:
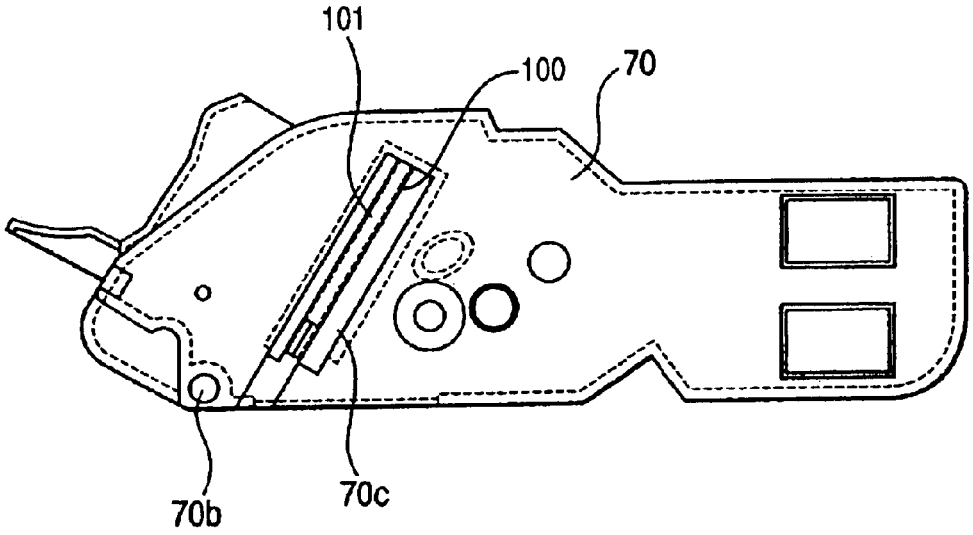
FIG. 19 is an elevation view showing a side cover and a seal grip according to the fourth embodiment of the invention.

It is certified that error appears in the above-identified patent and that said Letters Patent is hereby corrected as shown below:

Column 3,
Line 45, "FIG. 19" should be indented from the left margin to indicate the start of a new paragraph.

Column 6,
Line 2, "corresponding" should read -- corresponding with --.
Line 3, "ifs" should read -- this --.

Column 9,
Line 62, "41*a*," should read -- 41*o*, -- and "41*a*" should read -- 41*o* --.

Column 10,
Line 1, "in" should be deleted.
Line 50, 41*f*," should read -- 41*f* --.

Column 13,
Line 49, "41 g" should read -- 41*g* --.

Column 14,
Line 4, "developing," should read -- developing --.

Column 17,
Line 11, "1" should be deleted.

Column 19,
Line 9, "according" should read -- according to --.
Line 10, "42*p*2" should read -- 41*p*2 --.
Line 14, "42*p*2." should read -- 41*p*2. --.
Line 21, "grip 11" should read -- grip 111 --.
Line 27, "41*p* 1" should read -- 41*p*1 --.

UNITED STATES PATENT AND TRADEMARK OFFICE

CERTIFICATE OF CORRECTION

PATENT NO. : 6,834,171 B2
DATED : December 21, 2004
INVENTOR(S) : Nittani et al.

It is certified that error appears in the above-identified patent and that said Letters Patent is hereby corrected as shown below:

Column 22,
Line 2, “process-cartridge” should read -- process cartridge --.

Signed and Sealed this

Twenty-fourth Day of May, 2005

JON W. DUDAS
*Director of the United States Patent and Trademark Office*